US007457425B2

(12) United States Patent
Fincham

(10) Patent No.: US 7,457,425 B2
(45) Date of Patent: Nov. 25, 2008

(54) VEHICLE SOUND SYSTEM

(75) Inventor: Lawrence R. Fincham, Santa Rosa, CA (US)

(73) Assignee: THX Ltd., San Rafael, CA (US)

( * ) Notice: Subject to any disclaimer, the term of this patent is extended or adjusted under 35 U.S.C. 154(b) by 248 days.

(21) Appl. No.: 10/339,357

(22) Filed: Jan. 8, 2003

(65) Prior Publication Data

US 2003/0219137 A1 Nov. 27, 2003

Related U.S. Application Data

(63) Continuation-in-part of application No. 10/074,604, filed on Feb. 11, 2002, now Pat. No. 7,254,239.

(60) Provisional application No. 60/331,365, filed on Jan. 8, 2002, provisional application No. 60/267,952, filed on Feb. 9, 2001.

(51) Int. Cl.
*H04R 5/02* (2006.01)
*H04R 1/02* (2006.01)

(52) U.S. Cl. ..... 381/302; 381/300; 381/389

(58) Field of Classification Search ..... 381/17–20, 381/300–308, 1, 86, 89, 389, 335–336
See application file for complete search history.

(56) References Cited

U.S. PATENT DOCUMENTS

| | | | | |
|---|---|---|---|---|
| 2,440,078 A | | 4/1948 | Devine | |
| 3,371,742 A | | 3/1968 | Norton et al. | 181/153 |
| 3,617,654 A | * | 11/1971 | Heidrich | 381/346 |
| 4,016,953 A | | 4/1977 | Butler | 381/89 |
| 4,029,170 A | | 6/1977 | Phillips | 181/155 |

(Continued)

FOREIGN PATENT DOCUMENTS

EP 0404 117 A2 12/1990

(Continued)

OTHER PUBLICATIONS

Lopez, Jose, et al., "3-D Audio With Dynamic Tracking For Multimedia Environtments," Universidad Politecnica de Valencia, Departamento de Comunicaciones, Grao de Gandia, Spain, 2nd COST-G6 Workshop on Digital Audio Effects (DAFx99), Dec. 9-11, 1999, Trondheim, Norway.

(Continued)

*Primary Examiner*—Xu Mei
(74) *Attorney, Agent, or Firm*—Irell & Manella LLP

(57) ABSTRACT

A vehicle sound system encompasses a combination of speaker configuration, speaker placement, and sound processing to improve sound quality. A pair of speakers (or rows of speakers) are placed close together and located in the front of the console or dashboard with their geometric center on or near the vehicle's central axis. A sound processor acts to "spread" the sound image produced by the two closely spaced speakers by employing a cross-cancellation technique in which the cancellation signal is derived from the difference between the left and right channels. The resulting difference signal is scaled, delayed (if necessary), and spectrally modified before being added in opposite polarities to the left and right channels. The pair of speakers may be placed on a common baffle or mounting surface or in a common housing enclosure, with sound being carried through one or more ducts and emanating out of a slot.

38 Claims, 24 Drawing Sheets

U.S. PATENT DOCUMENTS

| | | | | | |
|---|---|---|---|---|---|
| 4,131,179 | A | | 12/1978 | Pope | 181/156 |
| 4,308,423 | A | * | 12/1981 | Cohen | 381/1 |
| 4,334,593 | A | | 6/1982 | Sechrist | 181/144 |
| 4,398,619 | A | | 8/1983 | Daniel | 181/156 |
| 4,509,184 | A | * | 4/1985 | Yanagawa | 381/308 |
| 4,574,906 | A | | 3/1986 | White et al. | 381/348 |
| 4,620,317 | A | | 10/1986 | Anderson | 381/90 |
| 4,628,528 | A | | 12/1986 | Bose et al. | 381/90 |
| 4,837,839 | A | | 6/1989 | Andrews | 381/199 |
| 4,846,382 | A | | 7/1989 | Foultner et al. | 224/42.42 |
| 5,036,946 | A | | 8/1991 | Yoshino | 181/156 |
| 5,067,159 | A | | 11/1991 | Kasai et al. | 381/90 |
| 5,115,470 | A | | 5/1992 | Sutheim | 381/76 |
| 5,138,526 | A | | 8/1992 | Chung Hsiang | 361/399 |
| 5,199,075 | A | | 3/1993 | Fosgate | 381/24 |
| 5,225,639 | A | * | 7/1993 | Kobayashi et al. | 181/151 |
| 5,253,301 | A | * | 10/1993 | Sakamoto et al. | 381/89 |
| 5,306,880 | A | | 4/1994 | Coziar et al. | 181/149 |
| 5,400,408 | A | | 3/1995 | Lundgren et al. | 381/88 |
| 5,432,860 | A | | 7/1995 | Kasajima et al. | 381/156 |
| 5,451,726 | A | | 9/1995 | Haugum | 181/150 |
| 5,471,018 | A | | 11/1995 | Nieuwendijk et al. | 181/152 |
| 5,561,717 | A | | 10/1996 | Lamm | 381/89 |
| 5,590,208 | A | * | 12/1996 | Koyano et al. | 381/338 |
| 5,610,992 | A | | 3/1997 | Hickman | 381/188 |
| 5,657,391 | A | | 8/1997 | Jyosako | 381/1 |
| 5,661,808 | A | | 8/1997 | Klayman | 381/1 |
| 5,677,957 | A | | 10/1997 | Hulsebus | 381/1 |
| 5,727,066 | A | | 3/1998 | Elliott et al. | 381/1 |
| 5,749,433 | A | | 5/1998 | Jackson | 181/156 |
| 5,862,227 | A | | 1/1999 | Orduna-Bustamante et al. | 381/17 |
| 5,870,484 | A | * | 2/1999 | Greenberger | 381/300 |
| 5,870,485 | A | | 2/1999 | Lundgren et al. | 381/306 |
| 5,902,023 | A | | 5/1999 | Yu et al. | 312/7.2 |
| 5,929,393 | A | | 7/1999 | Jeter, Jr. | 181/199 |
| 5,930,376 | A | | 7/1999 | Markow et al. | 381/333 |
| 5,943,431 | A | | 8/1999 | Weiss et al. | 381/305 |
| 5,949,894 | A | | 9/1999 | Nelson et al. | 381/300 |
| 6,198,826 | B1 | | 3/2001 | Cowieson et al. | 381/18 |
| 6,307,947 | B1 | | 10/2001 | Wiener | 381/386 |
| 6,363,157 | B1 | | 3/2002 | Chick | 381/89 |
| 6,771,787 | B1 | * | 8/2004 | Hoefler et al. | 381/338 |
| 2002/0085731 | A1 | * | 7/2002 | Aylward | 381/349 |
| 2002/0153193 | A1 | | 10/2002 | Toki | 181/148 |
| 2002/0154783 | A1 | | 10/2002 | Fincham | 381/17 |
| 2005/0129258 | A1 | | 6/2005 | Fincham | 381/160 |

FOREIGN PATENT DOCUMENTS

| | | | |
|---|---|---|---|
| GB | 2 074 823 | A | 11/1981 |
| JP | 52-004202 | | 1/1977 |
| JP | 56-016400 | | 2/1981 |
| JP | 56-162600 | | 12/1981 |
| JP | 63-502945 | | 10/1988 |
| JP | 64-018396 | | 1/1989 |
| JP | 04-137994 | | 5/1992 |
| JP | 05-014993 | | 1/1993 |
| JP | 08-154300 | | 6/1996 |
| JP | 11-252698 | | 9/1999 |
| JP | 11-318000 | | 11/1999 |
| JP | 2000-078700 | | 3/2000 |
| WO | WO 87/06090 | | 10/1987 |
| WO | WO 94/01981 | | 1/1994 |
| WO | WO 00/25618 | | 5/2000 |
| WO | WO 00/67522 | | 11/2000 |

OTHER PUBLICATIONS

Brown, C. Phillip, et al., "A Structural Model for Binaural Sound Synthesis," IEEE Transactions on Speech and Audio Processing, vol. 6, No. 5, Sep. 1998.

Jost, Adrian, et al., "Transaural 3-D With User-Controlled Calibration," Proceedings of the COST G-6 Conference on Digital Audio Effects (DAFX-00), Verona, Italy, Dec. 7-9, 2000.

Jot, Jean-Marc, "Synthesizing Three-Dimensional Sound Scenes in Audio or Multimedia Production and Interactive Human-Computer Interfaces," 5th International Conference: Interface to Real & Virtual Worlds, Montpellier, France, May 1996.

Kyriakakis, Chris, "Fundamental and Technological Limitations of Immersive Audio Systems," Proceedings of the IEEE, vol. 86, No. 5, May 1998.

Kendall, Gary S., "A 3D Sound Primer," Center for Music Technology, School of Music, Northwestern University, printout from website (www.northwestern.edu/musicschool/classes/3D/pages/sndPrmGK.html), printed Jan. 4, 2002.

Soebo, Asbjorn, "Effect of Early Reflections in Binaural Systems With Loudspeaker Reproduction," Acoustics Group, Department of Telecommunications, Norwegian University of Science and Technology (NTNU), Proc. 1999 IEEE Workshop on Applications of Signal Processing to Audio and Acoustics, New Paltz, New York, Oct. 17-20, 1999.

Zurek, P.M., "The Precedence Effect," *Directional Hearing*, Springer-Verlag, New York, 1987, pp. 85-105.

Trahiotis, Bernstein, "Some Modern Techniques and Devices Used to Preserve and Enhance the Spatial Qualities of Sound," *Directional Hearing*, Springer-Verlag, New York, 1987, pp. 279-290.

"Virtual Acoustics Project," Institute of Sound and Vibration Research, University of Southampton, printout from website (www.isvr.soton.ac.uk/FDAG/vap/), Feb. 4, 1998.

Kahana, et al, "Multi-Channel Sound Reproduction using a Four-Ear Dummy-Head," presented at the 102nd Audio Engineering Society Convention, Mar. 22-25, 1997, Munich, Germany.

Kahana, et al, "Objective and Subjective Assessment of Systems for the Production of Virtual Acoustic Images for Multiple Listeners," presented at the 102nd Audio Engineering Society Convention, Mar. 22-25, 1997, Munich, Germany.

Kahana, et al, "A Multiple Microphone Recording Technique for the Generation of Virtual Acoustic Images," Journal of the Acoustical Society of America, vol. 105, No. 3, Mar. 1999, pp. 1503-1516.

Kirkeby, et al, "Local Sound Field Reproduction using Digital Signal Processing," Journal of the Acoustical Society of America, vol. 100, No. 3, Sep. 1996, pp. 1584-1593.

Kirkeby, et al, "Virtual Source Imaging Over Loudspeakers," Proceedings of the Institute of Acoustics, vol. 19: Part 6, 1997.

Kirkeby, et al, "The 'Stereo Dipole': Binaural Sound Reproduction using Two Closely Spaced Loudspeakers," presented at the 102nd Audio Engineering Society Convention, Mar. 22-25, 1997, Munich, Germany.

Kirkeby, et al, "Acoustic Fields Generated by Virtual Source Imaging Systems," Proceedings of Active 97, The 1997 International Symposium on Active Control of Sound and Vibration, Aug. 21-23, 1997, Budapest, Hungary, pp. 941-954.

Nelson, et al, "Adaptive Inverse Filters for Stereophonic Sound Reproduction," IEEE Transactions on Signal Processing, vol. 40, No. 7, Jul. 1992, pp. 1621-1632.

Nelson, P. A., "Active Control of Acoustic Fields and the Reproduction of Sound," Journal of Sound and Vibration, vol. 177, No. 4, Nov. 3, 1994, pp. 447-477.

Nelson, et al, "Inverse Filter Design and Equalization Zones in Multichannel Sound Reproduction," IEEE Transactions on Speech and Audio Processing, vol. 3, No. 3, May 1995, pp. 185-192.

Nelson, et al, "Multichannel Signal Processing Techniques in the Reproduction of Sound," Journal of the Audio Engineering Society, vol. 44, No. 11, Nov. 1996, pp. 973-989.

Nelson, et al, "Experiments on a System for the Synthesis of Virtual Acoustics Sources," Journal of the Audio Engineering Society, vol. 44, No. 11, Nov. 1996, pp. 990-1007.

Nelson, et al, "Sound Fields for the Production of Virtual Acoustic Images," Journal of Sound and Vibration, vol. 204, No. 2, 1997, pp. 386-396.

Takeuchi, et al, "The Effects of Reflections on the Performance of Virtual Acoustic Imaging Systems," Proceedings of Active 97, The 1997 International Symposium on Active Control of Sound and Vibration, Aug. 21-23, 1997, Budapest, Hungary, pp. 927-940.

"LDSG Introduction—Enclosure designs," sponsored by Sonic Craft, Jul. 17, 2002.

P. Messenger, "KEF's Khameleon," *Hi-Fi News & Record Review*, Sep. 1984, pp. 29, and last page.

M. Colloms, "An Exercise in Conjugation," Hi-Fi News & Record Review, Sep. 1984, pp. 53-57.

U.S. Appl. No. 11/416,626, filed May 2006, Fincham.

* cited by examiner

Target Transfer Function Response Shapes

VEHICLE SOUND SYSTEM

RELATED APPLICATION INFORMATION

This application is a continuation-in-part application of U.S. application Ser. No. 10/074,604 filed on Feb. 11, 2002, now U.S. Pat. No. 7,254,239, which is a utility application claiming the benefit of U.S. Provisional Application Ser. No. 60/267,952, filed on Feb. 9, 2001, and further claims the benefit of U.S. Provisional Application Ser. No. 60/331,365, filed Jan. 8, 2002, and of PCT Application Ser. No. PCT/US02/03880, filed on Feb. 8, 2002, all of which are hereby incorporated by reference as if set forth fully herein.

BACKGROUND OF THE INVENTION

1) Field of the Invention

The field of the present invention relates to sound reproduction and, more specifically, to a speaker configuration and related sound processing for use in an automobile or vehicular sound system.

2) Background

Audio systems are commonplace in automobiles and certain other vehicles. Such systems generally utilize program sources ranging from simple radios to relatively elaborate stereo or multi-channel systems with CD and cassette players together with multiple equalizers, pre-amplifiers, power amplifiers etc.

While there is a great variety in the configuration and components of conventional automotive audio systems, most of them suffer to varying degrees from a number of persistent problems in providing the highest sound quality. These problems partially result from the unique sound environment of the automobile when compared with a good listening room. Among the disadvantages are:

- Much smaller internal volume resulting in a reduced reverberation time and lower modal density at low frequencies resulting in a lack of ambience and an uneven bass response.
- The proximity of highly reflective surfaces (such as the windows) to highly absorptive areas such as the upholstery or the occupants clothing leads to a great variability with frequency and head position of the direct to indirect sound arriving at the listener. Consequently even small changes in head or seating position can cause significant and undesirable changes in the timbral quality of the music.
- The listening positions are necessarily restricted to the seating positions provided (usually 4 or 5) and all of these are very asymmetrically placed with respect to the speaker positions. Space is always at a premium within a car interior and as a result the speakers are often placed in physically convenient positions, that are nevertheless very poor from an acoustic point of view, such as the foot wells and the bottom of the front and rear side doors. As a result the listener's head is always much closer to either the left or right speaker leading directly large inter-channel time differences and different sound levels due to the 1/r law.

Additionally, the angles between the axes from the listeners ears to the axes of symmetry of the left and right speakers is quite different for each occupant. The perceived spectral balance is different for each channel due to the directional characteristics of the drive units. Masking of one or more speakers by the occupants clothes or legs can often result in the attenuation of the mid- and high-frequencies by as much as 10 dB.

All of the above adversely impact the ability to produce high quality stereo reproduction, which ideally has the following attributes:

- A believable and stable image or soundstage resulting from the listener being nearly equidistant from the speakers reproducing the left and right channels and a sufficiently high ratio of direct-to-indirect sound at the listener's ears.
- A smooth timbral balance at all the listening positions.
- A sense of ambience resulting from a uniform soundfield.

Some features are provided in automobile audio systems which can partially mitigate the aforementioned problems. For example, an occupant can manually adjust the sound balance to increase the proportional volume to the left or right speakers. Some automobile audio systems have a "driver mode" button which makes the sound optimal for the driver. However, because different listening axes exist for left and right occupants, an adjustment to the balance that satisfies the occupant (e.g., driver) on one side of the automobile will usually make the sound worse for the occupant seated on the other side of the automobile. Moreover, balance adjustment requires manual adjustment by one of the occupants, and it is generally desirable in an automobile to minimize user intervention.

Another modification made to some automobile audio systems is to provide a center speaker, which reduces the image instability that occurs when the listener is closer to either the left or right speaker when both are reproducing the same mono signal, with the intention of producing a central sound image. Other potential approaches which might be taken in an attempt to mitigate the foregoing automotive sound problems include adding more speakers in a greater variety of positions (e.g., at the seat tops). While such techniques can sometimes provide a more pleasing effect, they cannot provide stable imaging as the problems associated with asymmetry described above still remain. The considerable additional cost of such design approaches is usually undesirable in the highly cost sensitive and competitive automotive industry. Moreover, as previously noted, space is usually at a premium in the automobile interior, and optimal speaker positions are limited.

Accordingly, it would be advantageous to provide an improved automotive sound system which overcomes one or more of the foregoing problems or shortcomings, and which can provide improved sound quality while minimizing any increase in cost of the audio system.

SUMMARY OF THE INVENTION

The present invention is generally directed in one aspect to an automotive sound system which encompasses a combination of speaker configuration, speaker placement, and sound processing to reduce or minimize the undesired sonic effects of the inevitable asymmetries between the listeners and speaker positions, in a car or similar vehicle, and provide more uniform sound for the occupants.

In one or more embodiments, an vehicle sound system comprises a pair of speakers placed close together and located in the front of the console or dashboard with their geometric center on (or as near as possible to) the central axis of symmetry of the vehicle. The sound system preferably comprises a sound processor which provides audio signals to the pair of speakers. Because the left and right center speakers are effectively adjacent to one another, the difference in time of arrival of the sound information to the listener becomes minimal, and the relative volume level of both speakers is perceived as approximately the same. Moreover, both the right and left occupant experience approximately the same volume level from the center pair of speakers, and the ratio of direct to indirect sound is maximized.

According to a preferred embodiment, the sound processor acts to "spread" the sound image produced by the two closely spaced speakers by employing a cross-cancellation technique in which, for example, the cancellation signal is derived from the difference between the left and right channels. The resulting difference signal can be scaled, delayed (if necessary), and spectrally modified before being added in opposite polarities to the left and right channels. The spectral modification to the difference channel preferably takes the form of a low-frequency boost over a specified frequency range, in order to restore the correct timbral balance after the differencing process which causes a loss of bass when the low-frequency signals in each channel are similar. Additional phase-compensating all-pass networks may be inserted in the difference channel to correct for the extra phase shift contributed by the usually minimum-phase-shift spectral modifying circuit so that the correct phase relationship between the canceling signal and the direct signal is maintained over the desired frequency range.

Alternatively, a linear-phase network may be employed to provide the spectral modification to the difference channel, in which case compensation can be provided by application of an appropriate, and substantially identical, frequency-independent delay to both left and right channels.

In various embodiments, the pair of central speakers may be placed in a common enclosure that is inserted into or else integral with the front console or dashboard of the automobile. In certain embodiments, the center speakers (or multiple speakers in series) may be placed with their diaphragms facing towards a rigid reflecting surface such that substantially all of the sound energy is directed forward via a sound duct or channel and out a narrow slot or orifice, towards the listener(s). The resultant radiating system may, in certain instances, provide the dual benefit of occupying less dashboard area, where space is at a premium, and possessing a very wide directional characteristics due to the slot or orifice having dimensions that can be made very small with respect to the wavelength the radiated sound.

The use of a pair of central speakers in conjunction with sound processing to provide improved sound quality may be employed in more than one location in the automobile. Thus, for example, a pair of rear central speakers with similar sound processing may be added in the rear of the vehicle, for example in the center above the rear seatback, for use in the play back of program with discretely encoded or simulated multi-channel surround sound. Likewise, for larger vehicles (e.g., a limousine), a pair of front central speakers may be used in both the driver compartment and the passenger compartment, the latter having applications for rear seat video presentations of films or music videos having multi-channel surround sound.

Further embodiments, variations and enhancements are also disclosed herein.

BRIEF DESCRIPTION OF THE DRAWINGS

FIG. 19A is a diagram of a speaker mounting structure or enclosure illustrating a particular arrangement of sound-damping material around the speakers, while

DETAILED DESCRIPTION OF PREFERRED EMBODIMENTS

Figure 1:
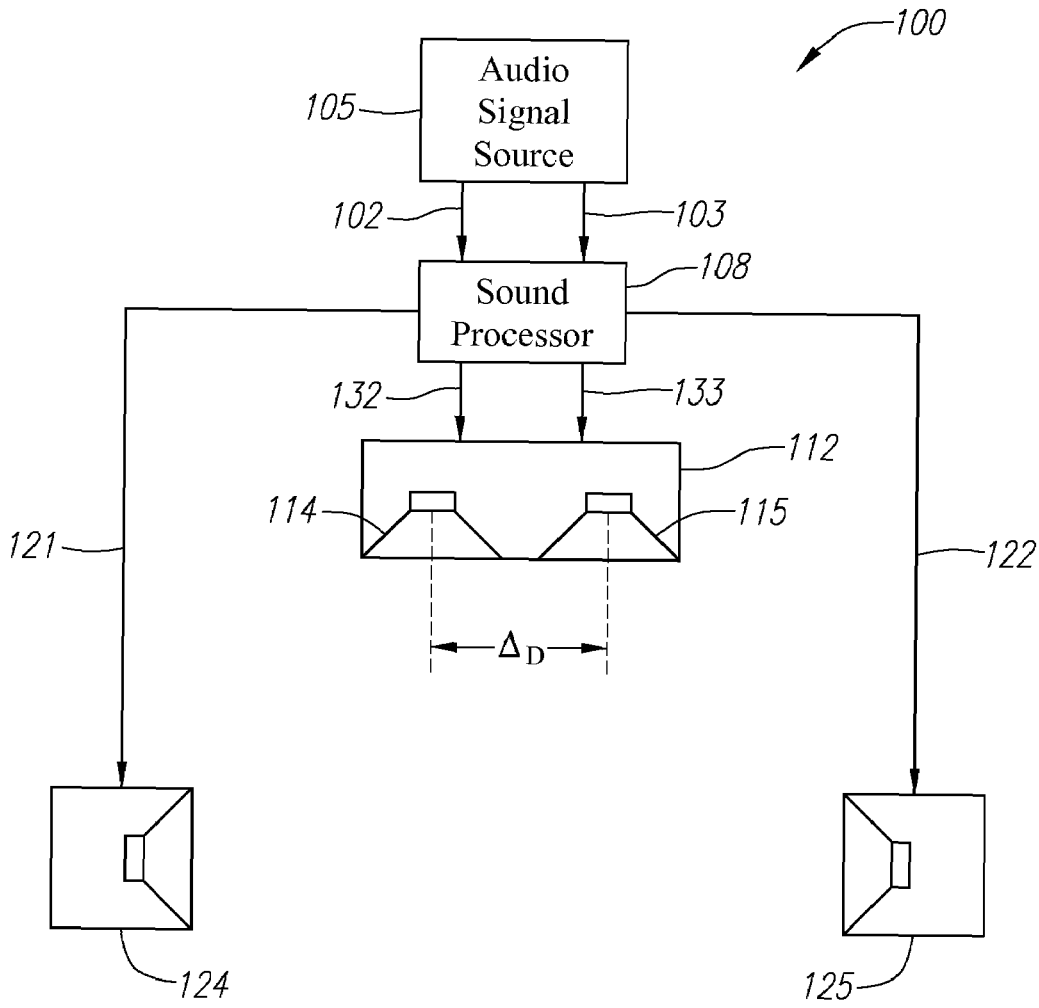
FIG. 1 is a diagram of a preferred automobile sound system in accordance with one or more embodiments as disclosed herein.

FIG. 1 is a diagram of a preferred automobile sound system 100 in accordance with one or more embodiments as disclosed herein. In FIG. 1, two speakers 114, 115 are positioned in close proximity to one another, and receive and respond to audio signals 132 and 133, respectively, from a sound processor 108. The speakers 114, 115 are preferably left and right speakers, may (but need not) be nominally identical, may be separated by a distance $\Delta_D$ from one another as further described herein, and may be of any suitable size and type provided that they fit within the size constraints of the available automotive compartment(s) or other space. Further, the speakers 114, 115 may be positioned along or near the central axis of the interior of the automobile, such as, for example, in the center console, or atop the center of the dashboard, or in a central island between the driver and passenger seats.

The sound processor 108 receives audio input signals 102 and 103 from a suitable audio signal source 105, from any typical automotive audio components (e.g., CD player, cassette player, radio, etc.) that may be included therewith. The audio input signals 102, 103 may be derived from any audio product, including any prerecorded medium (such as a cassette, CD, or DVD), any digital audio file, or any wireless (e.g., radio) broadcast received by the audio system. The sound processor 108 preferably processes the stereo sound signals 102, 103 according to techniques described in more detail herein, and provides the processed signals 132, 133 (after any desired amplification or level shifting) to the pair of closely spaced speakers 114, 115. The stereo signals 102, 103 may also optionally be fed, either directly or via the sound processor 118 (if certain additional or complementary sound processing is desired) to additional speakers, if any, such as left speaker 124 and right speaker 125 shown in FIG. 1.

In a preferred embodiment, the sound processor 108 acts to effectively "spread" the sound image by, in a broad sense, taking the difference between the two audio channels 102, 103, spectrally modifying the intermediate difference signal, and then, after scaling, adding it in appropriate polarity to the left and right channels. When the speakers 114, 115 are placed close together, side-by-side, the resulting phenomenon causes an apparent expansion of the stereo sound image despite the fact that the speakers 114, 115 are located in close proximity.

The bass lifting or spectral weighting carried out by the sound processor 108 may cause phase shifting, which can be compensated for using phase equalization. Complementary phase compensation can be provided along each of the audio channels 102, 103 prior to mixing (i.e., cross-cancellation) so that the left and right audio channels 102, 103 are substantially in phase with the spectrally modified difference signal. Where the bass lifting or spectral weighting is accomplished using linear phase filtering, however, no phase equalization may be needed or desired, although equal delays are preferably added to both the left and right audio channel paths in order to compensate for the additional delay produced by the linear-phase equalizer in the difference channel. The primary purpose of the speakers 114, 115 is not necessarily to provide only monaural information, as with a conventional centrally positioned speaker (although monaural information may be fed to the speakers 114, 115), but rather, when combined with suitable mid- to high-frequency processing and mixing (via the sound processor 108), to produce a symmetrical spreading of stereo information, which results in a better stereo presentation for both left and right occupants even when not directly on-axis.

Because the two center speakers 114, 115 are closely spaced with respect to one another, the difference in time of arrival of the sound information to a given listener becomes minimal, and the relative volume level of both speakers, as perceived by a given listener, is approximately the same. Moreover, both the right and left occupant will generally experience approximately the same volume level from the center pair of speakers 114, 115. In the event that the closely spaced speakers are unable to radiate potentially large out-of-phase, low-frequency components resulting from the cross-cancellation process, the very low frequencies can be isolated by means of a low-pass filter and directed to a separate sub-woofer, while a corresponding high-pass filter may be utilized to prevent high-level, low-frequency signals from overloading the smaller speakers. For any bass audio components that might be difficult for the relatively small center speakers 114, 115 to handle, the left and right audio channels 102, 103 can be fed to left and right bass speakers 121 and 122, respectively, possibly in conjunction with attenuation at mid/high frequencies and/or boosting at low/bass frequencies as provided by the sound processor 108 or any other suitable means. In embodiments in which mid/high frequencies are output by the center pair of closely spaced speakers and bass or low frequencies are output by left and right door-mounted speakers, advantages in amplifier efficiency may be achieved because less power will generally be needed to obtain higher volume levels.

When the speakers 114, 115 are placed in the front console or dashboard, or otherwise on or near the center axis of the automobile, they may (but need not be) mounted at a sufficient height so as to have a relatively unobstructed pathway to the listeners' ears, thus eliminating muffling or damping associated with obstructions such as seats and occupant bodies. In such embodiments, the speakers 114, 115 are located at an ideal or at least preferably acoustical position, being less obstructed and less reflected, and allowing more space for the sound to unfold.

Figure 3:
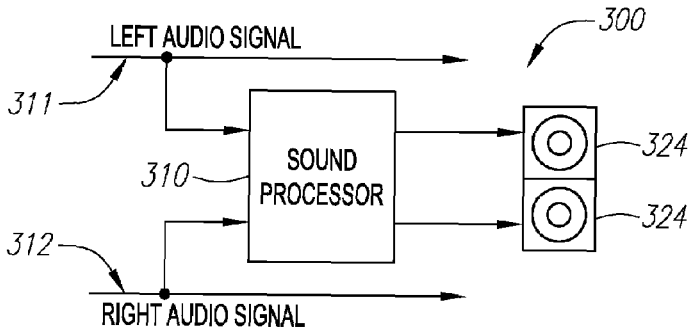
FIG. 3 is a simplified block diagram of a sound processing system in accordance with one or more embodiments as disclosed herein.

Further details regarding preferred techniques for sound processing in connection with the closely spaced speakers will now be described. FIG. 3 is a simplified block diagram of a sound processing system 300 in accordance with on embodiment as disclosed herein, as may be used, for example, in connection with the automobile sound system 100 and speaker configuration illustrated in FIG. 1, or more generally, in any sound system which utilizes multiple audio channels to provide stereo source signals. As shown in FIG. 3, a left audio signal 311 and right audio signal 312 are provided to a sound processor 310, and then to a pair of closely spaced speakers 324, 325. The left audio signal 311 and right audio signal 312 may also be provided to left and right side (surround or non-surround) speakers, not shown in FIG. 3. In a preferred embodiment, the sound processor 310 generates a spectrally weighted difference signal from the left and right channel audio signals 311, 312, and mixes the spectrally weighted difference signal (adjusting for appropriate polarity) with the left and right channel audio signals 311, 312 to provide a cross-cancellation effect prior to applying the resulting signals to the pair of speakers 324, 325, thereby widening the sound image produced by the speakers 324, 325 to provide an effect of stereo sound despite the close proximity of the speakers 324, 325.

Figure 4:
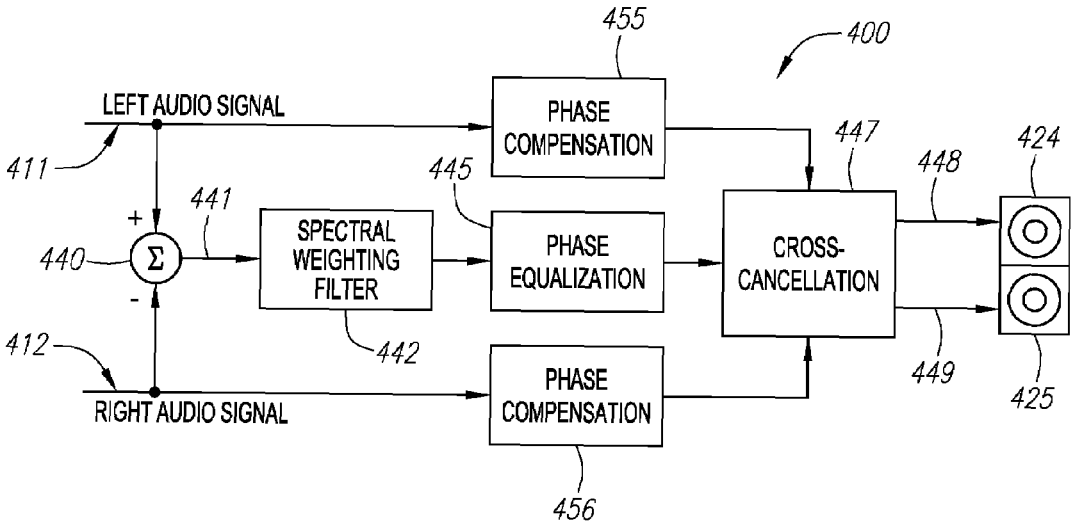
FIG. 4 is a more detailed diagram of a sound processing system.

FIG. 4 is a more detailed diagram of a sound processing system 400 in accordance with various principles as disclosed herein, and as may be used, for example, in connection with the automobile sound system 100 illustrated in FIG. 1, or more generally, in any sound system which utilizes multiple audio channels to provide stereo source signals. In the sound processing system 400 of FIG. 4, a left audio signal 411 and right audio signal 412 are provided from an audio source, and may be fed to other speakers as well (not shown in FIG. 4). The difference between the left audio signal 411 and right audio signal 412 is obtained by, e.g., a subtractor 440, and the difference signal 441 is fed to a spectral weighting filter 442, which applies a spectral weighting (and possibly a gain factor) to the difference signal 441. The characteristics of the spectral weighting filter 442 may vary depending upon a number of factors including the desired aural effect, the spacing of the speakers 424, 425 with respect to one another, the taste of the listener, and so on. The output of the spectral weighting filter 442 may be provided to a phase equalizer 445, which compensates in part for the phase shifting effect caused by the spectral weighting filter 442 (if non-linear).

In FIG. 4, the output of the phase equalizer 445 is provided to a cross-cancellation circuit 447. The cross-cancellation circuit 447 also receives the left audio signal 411 and right audio signal 412, as adjusted by phase compensation circuits 455 and 456, respectively. The phase compensation circuits 455, 456, which may be embodied as, e.g., all-pass filters, shift the phase of their respective input signals (i.e., left and right audio signals 411, 412) in a complementary manner to the phase shifting performed by the phase equalizer 445 (and the inherent phase distortion caused by the spectral weighting filter 442). The cross-cancellation circuit 447, which may include a pair of summing circuits (one for each channel), then mixes the spectrally-weighted, phase-equalized difference signal, after adjusting for appropriate polarity, with each of the phase-compensated left audio signal 411 and right audio signal 412. The perceived width of the soundstage produced by the pair of speakers 424, 425 can be adjusted by varying the gain of the difference signal path, and/or by modifying the shape of the spectral weighting filter 442.

Figure 15A:
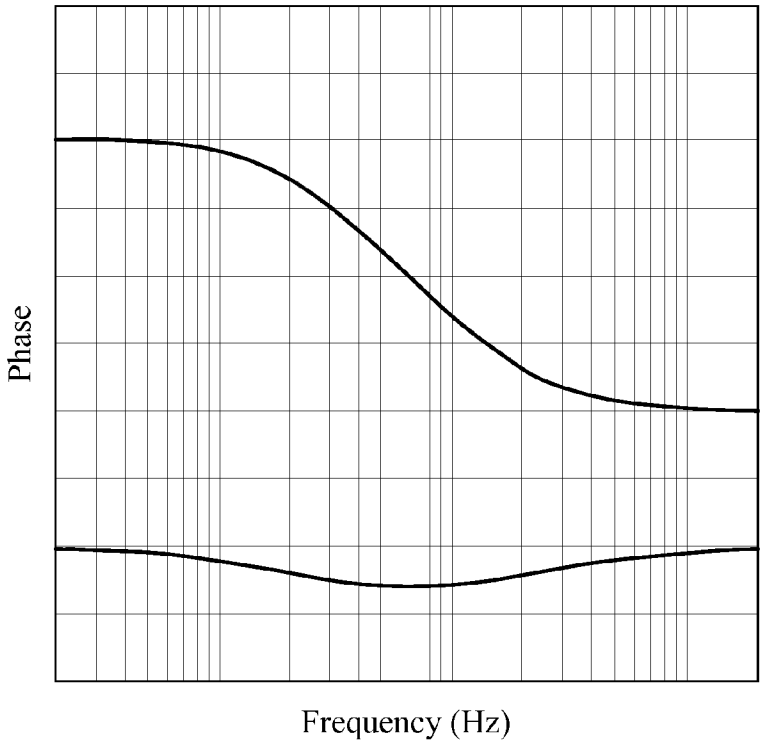
Figure 16:
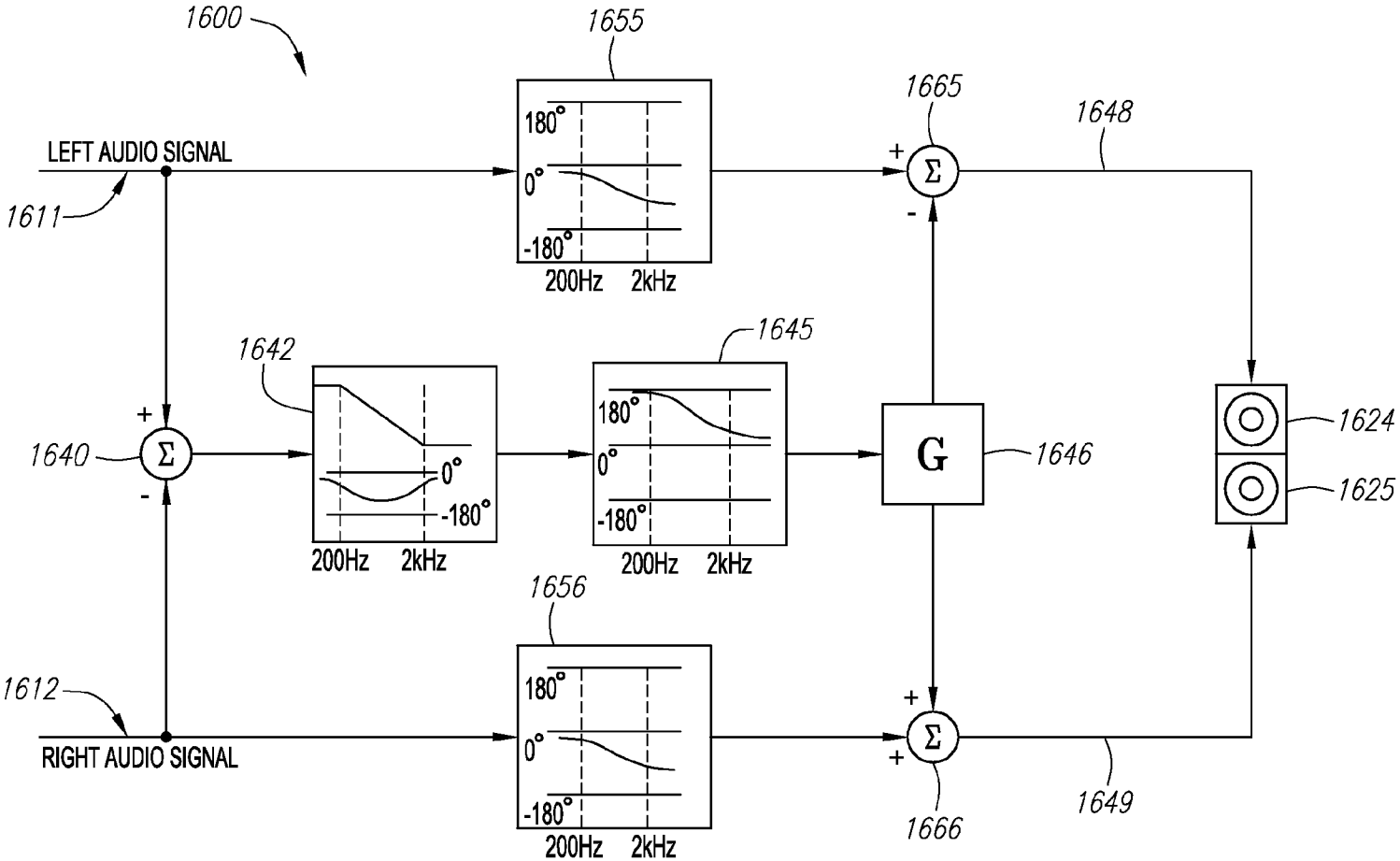
FIG. 16 is a diagram of a sound processing system in general accordance with the layout illustrated in FIG. 4, further showing examples of possible transfer function characteristics for certain processing blocks.

FIG. 16 is a diagram of a sound processing system 900 in general accordance with the principles and layout illustrated in FIG. 4, further showing typical examples of possible transfer function characteristics for certain processing blocks. As with FIG. 4, in the sound processing system 1600 a left audio signal 1611 and a right audio signal 1612 are provided from an audio source (not shown), and a difference signal 1641 is obtained representing the difference between the left audio signal 1611 and the right audio signal 1612. The difference signal 1641 is fed to a spectral weighting filter 1642, which, in the instant example, applies a spectral weighting to the difference signal 1641, the characteristics of which are graphically illustrated in the diagram of FIG. 16. A more detailed graph of the transfer function characteristics (both gain and phase) of the spectral weighting filter 1642 in this example appears in FIG. 15A. As shown therein, the spectral weighting filter 1642 is embodied as a first-order shelf filter with a gain of 0 dB at low frequencies, and turn-over frequencies at approximately 200 Hz and 2000 Hz. If desired, the gain applied by gain/amplifier block 1646 can be integrated with the spectral weighting filter 1642, or the gain can be applied downstream as illustrated in FIG. 16. In any event, as previously noted, the turnover frequencies, amount of gain, slope, and other transfer function characteristics may vary depending upon the desired application and/or overall system characteristics.

A phase equalizer 1645 is provided in the center processing channel, and addition phase compensation circuits 1655 and 1656 in the right and left channels, to ensure that the desired phase relationship is maintained, over the band of interest, between the center channel and the right and left channels. As shown graphically in both FIG. 16 and in more detail in FIG. 15A, the spectral weighting filter 1642 in the instant example causes a phase distortion over at least the 200 Hz to 2000 Hz range. The phase equalizer 1645 provides no gain, but modifies the overall frequency characteristic of the center channel. The phase compensation circuits 1655 and 1656 likewise modify the phase characteristics of the left and right channels, respectively. The phase compensation is preferably selected, in the instant example, such that the phase characteristic of the center channel (that is, the combined phase effect of the spectral weighting filter 1642 and the phase equalizer 1645) is approximately 180° out-of-phase with the phase characteristic of the left and right channels, over the frequency band of interest (in this example, over the 200 Hz to 2000 Hz frequency band). At the same time, the phase characteristic of the left and right channels are preferably remains the same, so that, among other things, monaural signals being played over the left and right channels will have identical phase processing on both channels (and thus maintain proper sound characteristics). Therefore, the phase compensation circuits 1655 and 1656 preferably are configured to apply identical phase processing to the left and right channels.

Figure 15B:
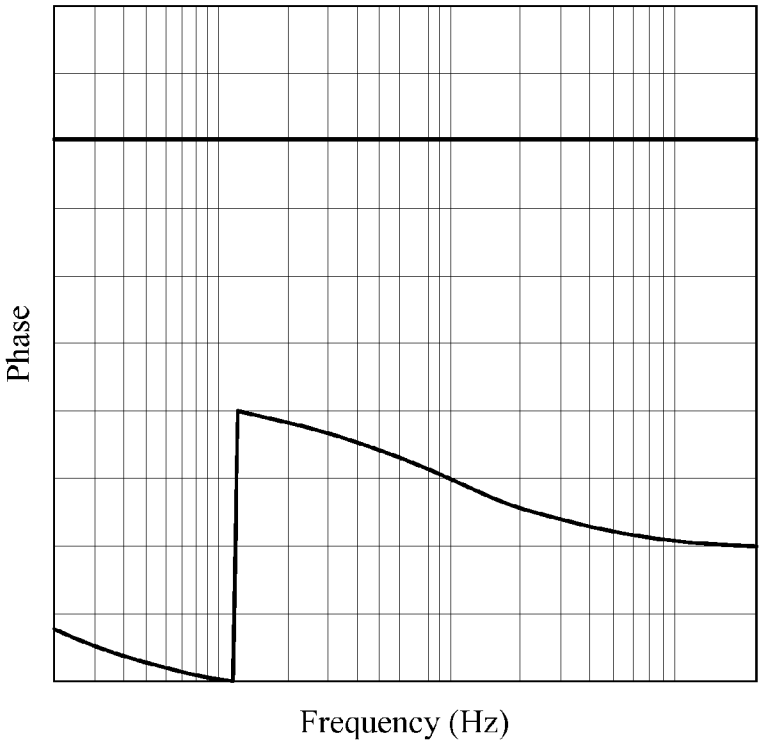
FIGS. 15A, 15B, and 15C are graphs illustrating examples of gain and/or phase transfer functions for a sound processing system in accordance with FIG. 16.
Figure 15C:
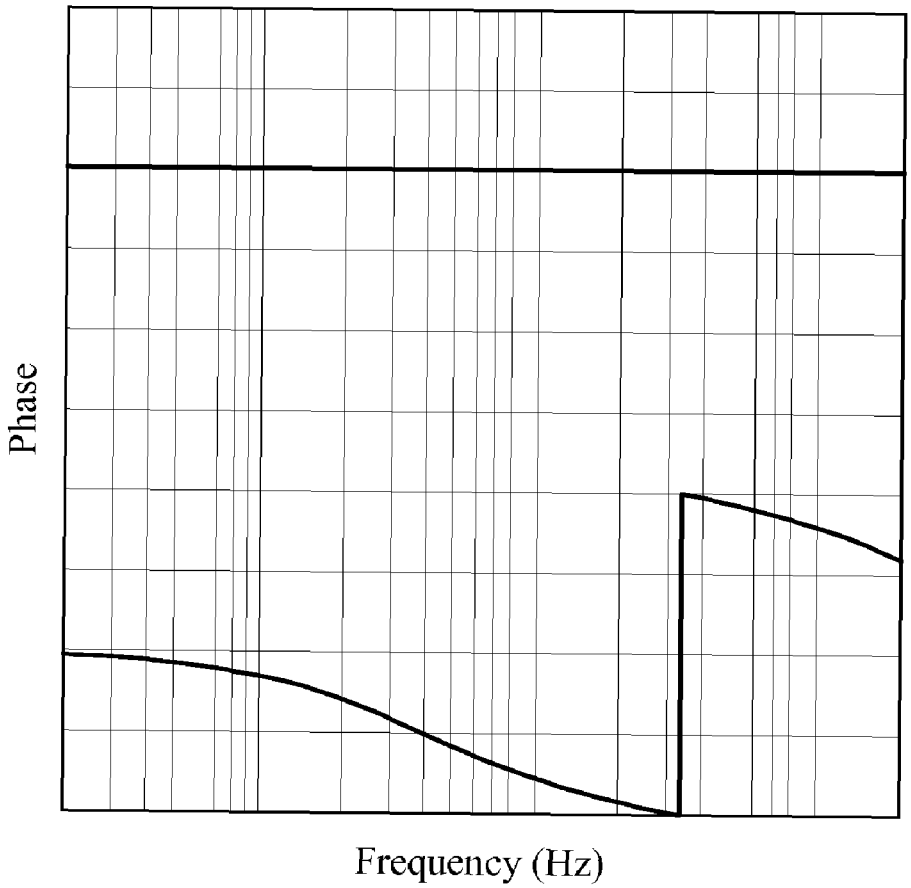

More detailed graphical examples of gain and phase transfer functions (with the gain being zero in this case when the components are embodied as all-pass filters) are illustrated for the center channel phase equalizer 1645 in FIG. 15B and for the left and right channels phase compensation circuits 1655, 1656 in FIG. 15C. In these examples, the phase equalizer 1645 is embodied as a second-order all-pass filter (with F=125 Hz and Q=0.12), and the phase compensators 1655, 1656 are each embodied as second-order all-pass filters (with F=3200 Hz and Q=0.12). A higher Q value may be used to increase the steepness of the phase drop-off, reducing the extent to which the center channel is out-of-phase with the left and right channels at low frequencies (thus minimizing the burden imposed upon the speakers 1624, 1625).

Figure 6:
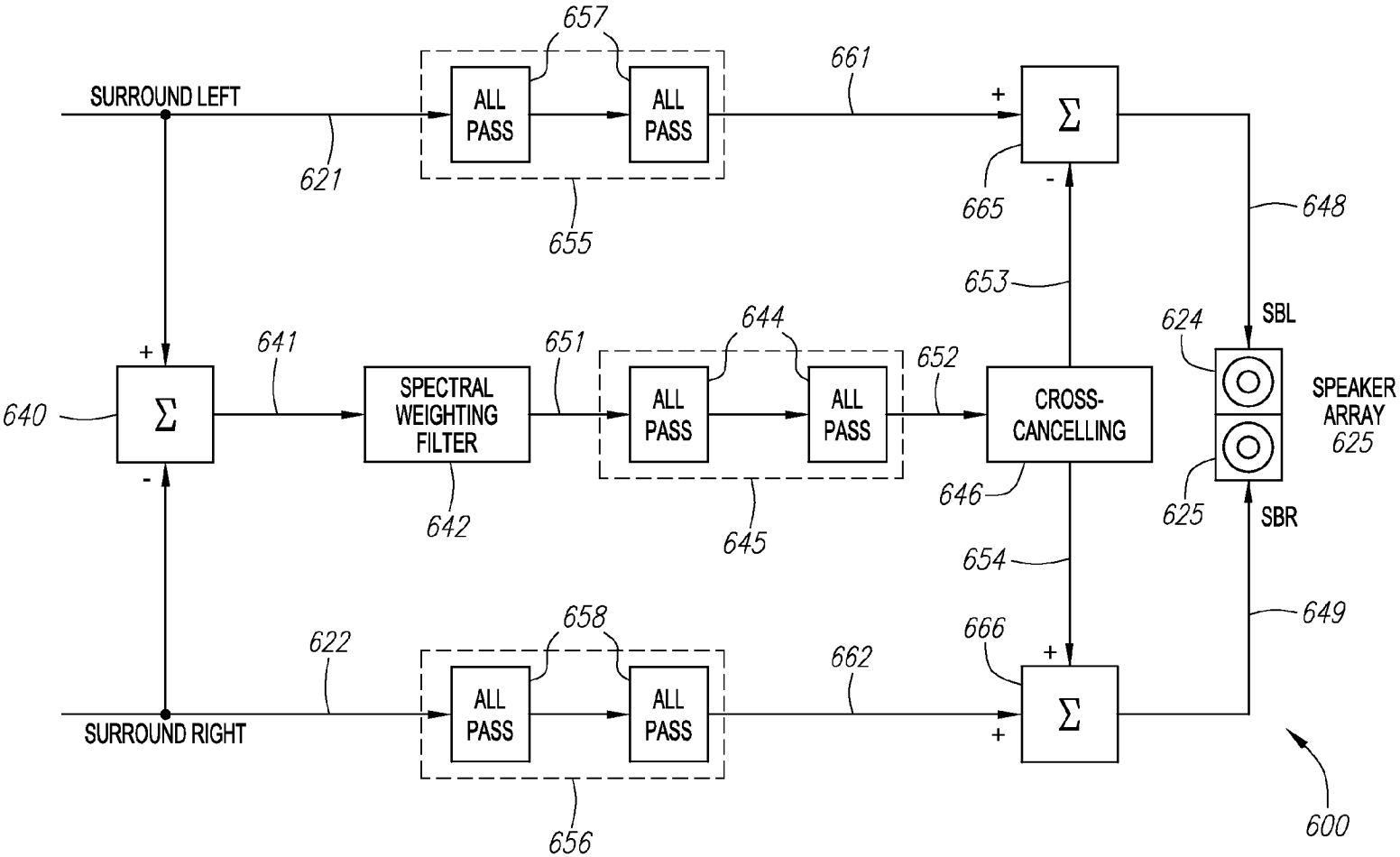
FIG. 6 is a diagram of a sound system in accordance with the general principles of the systems illustrated in FIGS. 4 and 5, as applied in the context of a surround sound system.

FIG. 6 illustrates another implementation of the sound system 400 shown in FIG. 4, where all-pass filters are used to provide phase equalization and/or compensation.

Figure 5:
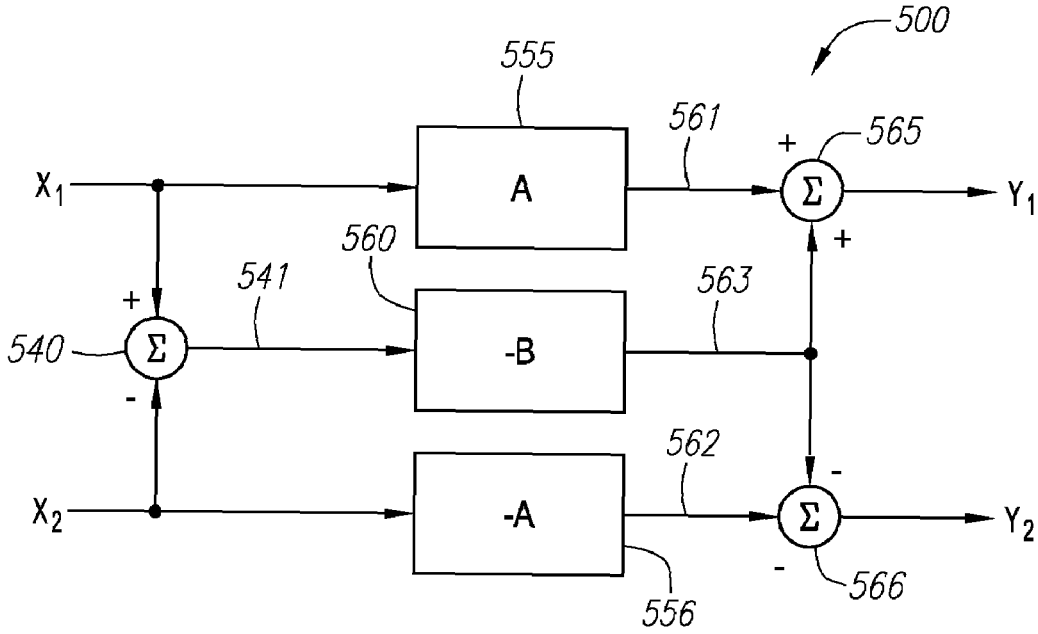
FIG. 5 is a diagram of a sound processing system illustrating representative transfer functions.

FIG. 5 is another diagram of a sound processing system 500, in accordance with the general principles explained with respect to FIGS. 3 and 4, illustrating representative transfer functions according to an exemplary embodiment as described herein. In the sound processing system 500 shown in FIG. 5, input audio signals X1 and X2 (e.g., left and right audio signals) are processed along two parallel paths, and the resultants individually summed together and provided as output signals Y1 and Y2, respectively (which may be fed to a pair of speakers, e.g., left and right speakers located in close proximity). A difference between the input audio signals X1 and X2 is obtained from a subtractor 540, which provides the resulting difference signal 540 to a processing block 560 having a transfer function −B. The first input audio signal X1 is also fed to a processing block 555 having a transfer function A, and the output of processing block 555 is added together with the output of processing block 560 and fed as the first output signal Y1. Likewise, the second input audio signal X2 is fed to a processing block 556 having a transfer function −A (i.e., the complement to the transfer function A of processing block 555), and the output of processing block 556 is inverted and added together with the inverted output of processing block 560, then fed as the second output signal Y2. The overall relationship between the inputs and the outputs of the FIG. 5 sound processing system 500 can be expressed as:

$$A\left(\begin{bmatrix}1 & 0\\ 0 & 1\end{bmatrix}+B\begin{bmatrix}-1 & 1\\ 1 & -1\end{bmatrix}\right)\begin{bmatrix}x_1\\ x_2\end{bmatrix}=\begin{bmatrix}y_1\\ y_2\end{bmatrix}$$

In a preferred embodiment, the transfer function −B of processing block 560 represents the combined transfer functions of a spectral weighting filter of desired characteristics and a phase equalizer, such as illustrated by the difference path in the sound processing system 400 of FIG. 4. Also in a preferred embodiment, the transfer functions A and −A of processing blocks 555 and 556, respectively, each represent the transfer function of a phase compensation network that performs a complementary phase shifting to compensate for the phase effects caused by the processing block 560. The polarities in FIG. 5 are selected so that appropriate cross-cancellation will be attained.

In a preferred embodiment, input signals X1 and X2 represent the Z-transforms of the left and right audio channel inputs, and Y1 and Y2 represent the corresponding Z-transforms of the left and right channel outputs which feed the pair of speakers (e.g., left and right speakers) located in close proximity. The transfer functions A, −A, and B may be represented in terms of z, and are determined in part by the sampling frequency $F_s$ associated with processing in the digital domain. According to a particular embodiment, blocks 555 and 556 are each second-order all-pass filters with f=3200 Hertz, Q=0.12, and may, in one example, possess the following transfer function characteristics based upon representative examples of the sampling frequency $F_s$:

$$\text{For } F_S = 48 \text{ KHz, } A(z) = \frac{-0.2578123 - 0.6780222z^{-1} + z^{-2}}{1 - 0.6780222z^{-1} - 0.2578123z^{-2}}$$

$$\text{For } F_S = 44.1 \text{ KHz, } A(z) = \frac{-0.2944196 - 0.633509z^{-1} + z^{-2}}{1 - 0.633509z^{-1} - 0.2944196z^{-2}}$$

$$\text{For } F_S = 32 \text{ KHz, } A(z) = \frac{-0.4201395 - 0.469117z^{-1} + z^{-2}}{1 - 0.469117z^{-1} - 0.4201395z^{-2}}$$

In this particular embodiment, block 560 may be a first-order shelf having a gain of 0 dB at low frequencies and turn-over frequencies of 200 Hertz and 2 KHz in cascade with a second-order all pass filter, with f=125 Hz, Q=0.12, and may, in one example, possess the following transfer function characteristics based upon representative examples of the sampling frequency $F_s$:

For $F_S = 48$ KHz, $$B(z) = G \times \frac{0.1116288 - 0.0857871z^{-1}}{1 - 0.9741583z^{-1}} \times \frac{0.8723543 - 1.872104z^{-1} + z^{-2}}{1 - 1.872104z^{-1} + 0.8723543z^{-2}}$$

For $F_S = 44.1$ KHz, $$B(z) = G \times \frac{0.1126427 - 0.0845478z^{-1}}{1 - 0.9719051z^{-1}} \times \frac{0.8618468 - 1.861552z^{-1} + z^{-2}}{1 - 1.861552z^{-1} + 0.8618468z^{-2}}$$

For $F_S = 32$ KHz,

-continued $$B(z) = G \times \frac{0.1173312 - 0.0788175z^{-1}}{1 - 0.9614863z^{-1}} \times \frac{0.814462 - 1.813915z^{-1} + z^{-2}}{1 - 1.813915z^{-1} + 0.814462z^{-2}}$$

A gain factor may also be included in block 560, or else may be provided in the same path but as a different block or element. The gain may be determined for a particular application by experimentation, but is generally expected to be optimal in the range of 10-15 dB. In one embodiment, for example, the gain factor is 12 dB.

Figure 7A:
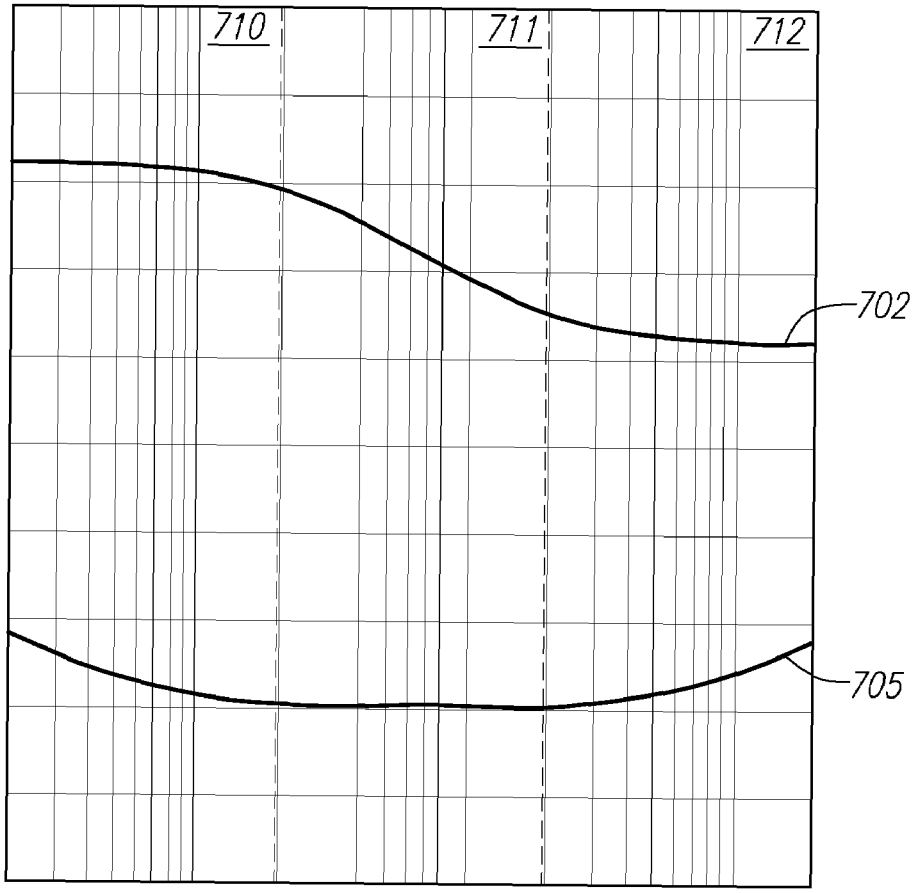
FIGS. 7A and 7B are graphs illustrating examples of frequency response and phase transfer functions for a sound processing system in accordance with FIG. 5 and having particular spectral weighting, equalization and phase compensation characteristics.
Figure 7B:
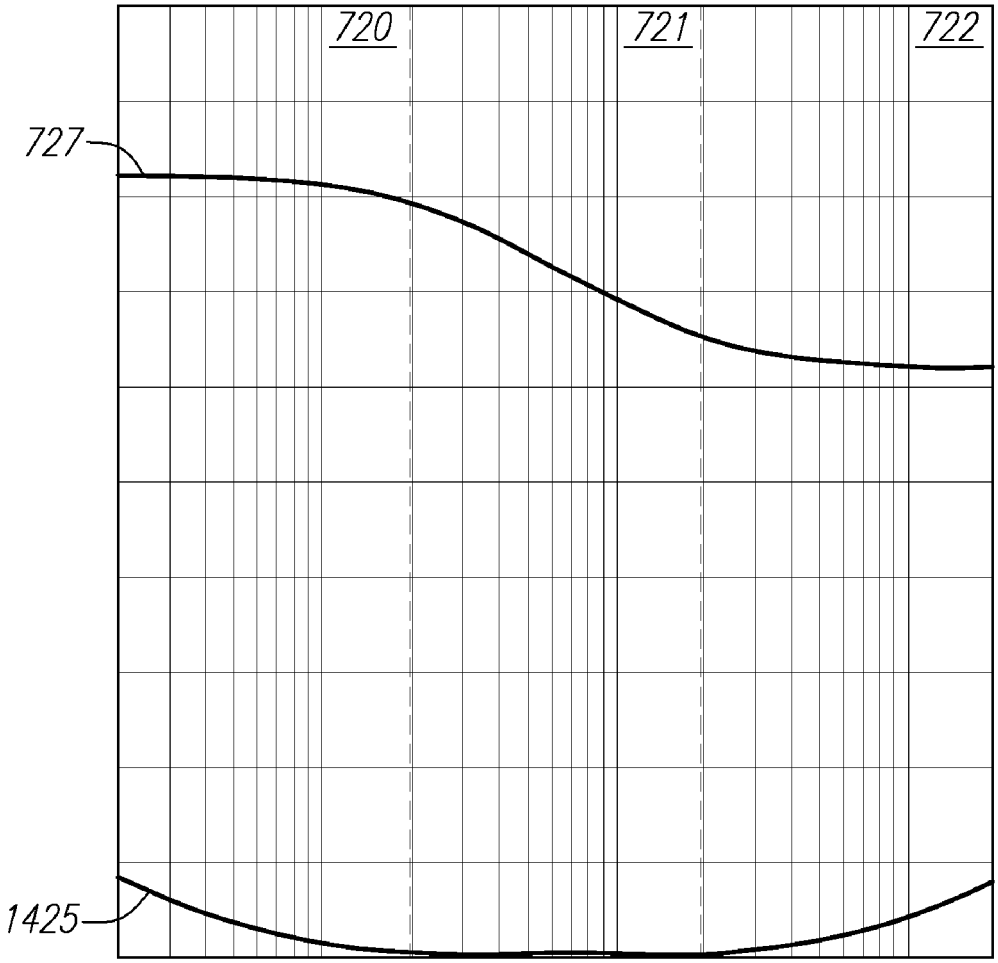

FIGS. 7A and 7B are graphs illustrating examples of frequency response and phase transfer functions for a sound processing system in accordance with FIG. 5 and having particular spectral weighting, equalization and phase compensation characteristics. FIG. 7A illustrates a frequency response transfer function 702 and phase transfer function 705 for −B/A, which represents the transfer function of the difference channel (−B) and the first input channel (X1) with +12 dB of gain added. As shown in FIG. 7A, the frequency response transfer function 702 exhibits a relatively flat gain in a first region 710 of bass frequencies (in this example, up to about 200 Hertz), a decreasing gain in a second region 711 of mid-range frequencies (in this example, from about 200 Hertz to about 2 KHz), and then a relatively flat gain again in a third region 712 of high frequencies (in this example, above 2 KHz). The phase response transfer function 705 indicates that in the second region 711 of mid-range frequencies (i.e., between about 200 Hertz and 2 KHz) the output signal remains substantially in phase.

FIG. 7B illustrates a frequency response transfer function 727 and phase transfer function 725 for −B/−A, which represents the transfer function of the difference channel (−B) and the first input channel (X2) with +12 dB of gain added. In FIG. 7B, as with FIG. 7A, the frequency response transfer function 727 exhibits a relatively flat gain in a first region 720 of bass frequencies (in this example, up to about 200 Hertz), a decreasing gain in a second region 721 of mid-range frequencies (in this example, from about 200 Hertz to about 2 KHz), and then a relatively flat gain again in a third region 722 of high frequencies (in this example, above 2 KHz). The phase response transfer function 725 indicates that in the second region 721 of mid-range frequencies (i.e., between about 200 Hertz and 2 KHz) the output signal is substantially inverted in phase (i.e., at 180 degrees).

As noted, the output signals Y1, Y2 are preferably provided to a pair of speakers located in close proximity. The transfer functions A, −A, and B are examples selected for the situation where the speakers are located substantially adjacent to one another. However, benefits may be attained in the system 500 of FIG. 5 where the pair of speakers are not immediately adjacent, but are nevertheless in close proximity with one another.

Figure 10:
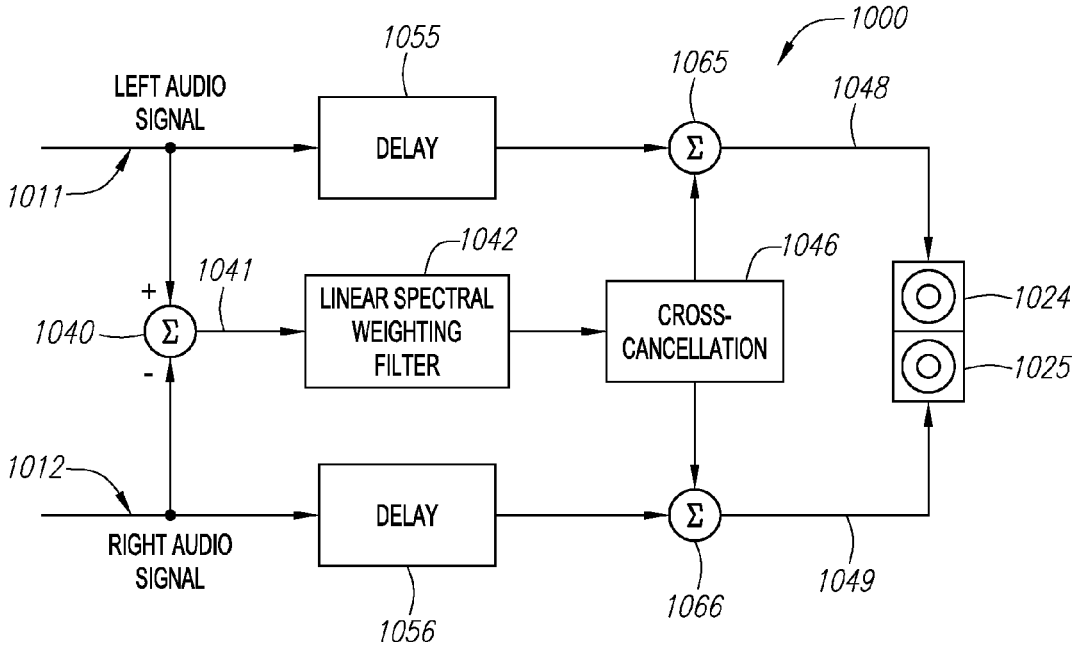
FIG. 10 is a diagram of a sound processor employing a linear spectral weighting filter.

FIG. 10 is a diagram of a sound processing system 1000 in accordance with an alternative embodiment as described herein, employing a linear spectral weighting filter. In the sound processing system 1000 of FIG. 10, a left audio signal 1011 and right audio signal 1012 are processed to derive a pair of processed audio signals 1048, 1049 which are applied to a pair of closely spaced speakers 1024, 1025 (e.g., left and right speakers). The left and right audio signals 1011, 1012 are operated upon by a subtractor 1040, which outputs a difference signal 1041 representing a difference between the left and right audio signals 1011, 1012. The difference signal 1041 is fed to a spectral weighting filter 1042 having a linear phase characteristic. The spectral weighting filter 1042 may have frequency response characteristics in general accordance, for example, with the transfer function illustrated in FIG. 7A or 7B. Because the spectral weighting filter 1042 has a linear phase characteristic, phase equalization and compensation are not necessary. Therefore, the output of the spectral weighting filter 1042 may be provided directly to a cross-cancellation circuit 1046, which then mixes the spectrally weighted signal with each of the left and right audio channels before applying them to the speakers 1024, 1025. To compensate for the delay caused by the spectral weighting filter 1042, delay components 1055 and 1056 may be added along the left and right channel paths, respectively. The delay components 1055, 1056 preferably have a delay characteristic equal to the latency of the linear spectral weighting filter 1042.

The amount of cross-cancellation provided by the sound processing in various embodiments generally determines the amount of "spread" of the sound image. If too much cross-cancellation is applied, then the resulting sound can seem clanky or echoey. If too little cross-cancellation is applied, on the other hand, the sound image may not be sufficiently widened.

The pair of speakers (e.g., speakers 114 and 115 in FIG. 1) which receive the sound processed information are preferably located immediately adjacent to one another; however, they may also be separated by some distance $\Delta_D$ while still providing benefits of enlarged sound image, increased stability, and so on. Generally, the farthest maximum separation of the speakers 114, 115 can be determined by experimentation, but performance may gradually decline as the speakers 114, 115 are moved farther apart from one another. Preferably, the pair of speakers 114, 115 are placed no further apart than a distance that is comparable with the wavelength of the highest frequency that is intended to be radiated by the speakers 114, 115. For a maximum frequency of 2 kHz, this would correspond to a center-to-center spacing of about 6 inches between speakers 114 and 115. However, ideally the speakers 114, 115 are placed immediately next to one another, in order to attain the maximum benefit from the sound processing techniques as described herein.

Figure 2A:
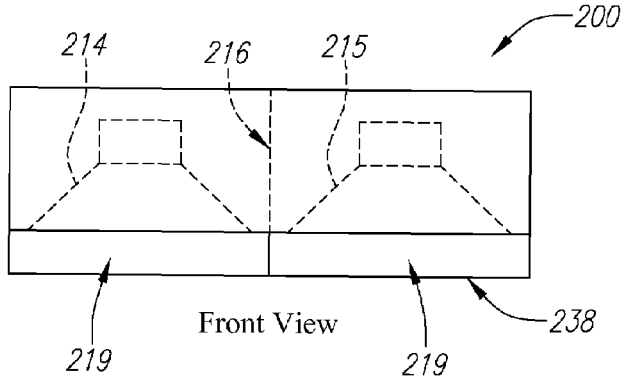
FIG. 2A is a front cut-away view of an embodiment of a speaker enclosure for a pair of stereo speakers.
Figure 2B:
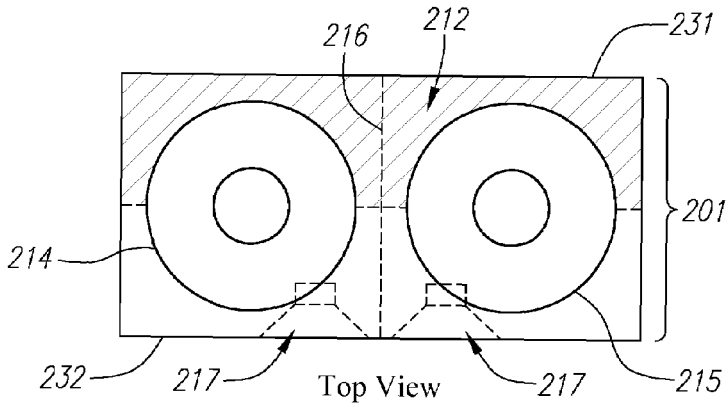
FIG. 2B is a top cross-sectional view of the speaker enclosure shown in FIG. 2A.
Figure 2C:
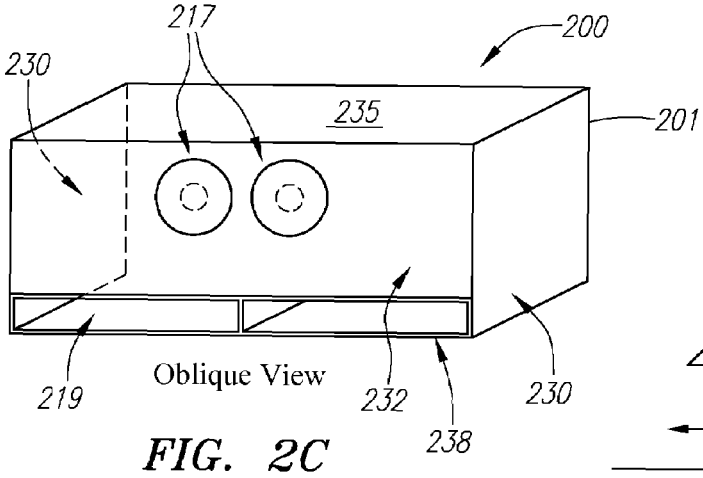
FIG. 2C is an oblique front view of the speaker enclosure shown in FIGS. 2A and 2B.

When the pair of speakers 114, 115 are closely spaced, they may be placed on a common mounting structure—for example, in a common enclosure, with a central (preferably airtight) dividing partition—that may, for example, be inserted into or else integral with the front console or dashboard of an automobile, or placed elsewhere near the central axis of the automobile. FIGS. 2A, 2B and 2C illustrate one example of an enclosure 201, particularly suited to applications where space is-limited, housing a pair of speakers 214, 215 which can receive and respond to sound processed signals from left and right audio channels in accordance with the various techniques described herein. FIG. 2A is a front cutaway view of the exemplary speaker enclosure 201 housing the pair of speakers 214, 215; FIG. 2B is a top cross-sectional view of the speaker enclosure 201 shown in FIG. 2A; and FIG. 2C is an oblique front view of the speaker enclosure 201 shown in FIGS. 2A and 2B. As shown perhaps best in FIG. 2C, the speaker enclosure 201 in this example is preferably substantially rectangular in shape, and is preferably designed with dimensions so as to slide into or otherwise fit within a standard or double "DIN" slot in the front console space of an automobile. The speaker enclosure 201 may include a front panel 232, a pair of side panels 230, a top panel 235, a bottom panel 239, and possibly a back panel 231. To achieve isolation between the two speakers 214, 215, an interior wall 216 such as illustrated in FIGS. 2A and 2B may be placed between the speakers 214, 215, thus creating two separate speaker chambers, one housing each of the two speakers 214, 215. The speakers 214, 215 are preferably positioned or mounted on a baffle, a mounting surface, or other barrier so as to acoustically isolate their rear radiation from their front radiation.

The pair of speakers 214, 215 may be pointed directly frontwards; however, in the instant example, the speakers 214, 215 are oriented downwards, as illustrated in FIG. 2A. When so oriented, a slot 219 may be located at the bottom of the speaker enclosure 201, to allow the sound from the speakers 214, 215 to radiate outwards towards the direction of the listeners in the automobile. Effectively, then, the speakers 214, 215 only take up an amount of console/dash surface space corresponding to the size of the slot 219. In an automobile environment, front console/dash space is typically extremely valuable since it is scarce, and thus the ability to position two speakers 214, 215 in the front console/dash while minimizing the amount of surface space consumed can be extremely advantageous. Audio system controls/display(s) or other conventional console accouterments (controls, LCD or other displays, air vents, etc.) can be attached to or integral with the front panel 232 of the speaker enclosure 201, so the available surface space on the front panel 232 is valuably utilized.

Moreover, when so oriented, the speakers 214, 215 may be potentially larger in size (assuming console space is limited); for example, each speaker may be about 4" (for a total of approximately 8" across collectively), which may fit into a standard DIN space or other similar space, whereas the speakers would otherwise generally have to be under perhaps 2" to 2½" or less to fit within the DIN space (or other similar center console space), if oriented in a frontwards direction. The ability to place larger speakers in the center speaker unit may, among other advantages, allow better bass reproduction then would be the case with smaller centrally located speakers and, hence, can reduce or potentially dispense with the need for side (e.g., door-mounted) bass speakers to carry the bass information of the left and right channels.

Figure 2D:
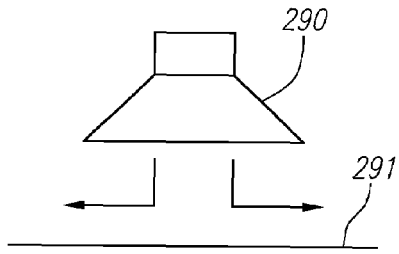
FIG. 2D is a diagram illustrating sound reflection from a downward oriented speaker, such as a speaker in the speaker enclosure of FIGS. 2A-2C.

The effect of orienting the speakers 214, 215 in a downward direction is conceptually illustrated in FIG. 2D, which shows a generic speaker 290 pointing downwards towards a surface 291. The sound output from the speaker 290 radiates outward from the centerpoint along the surface 291 in essentially all directions (i.e., a complete 360-degree circle). Thus, as shown in FIGS. 2A and 2C, a slot 219 is preferably located at the bottom of the speaker enclosure 201, to allow the sound from the speakers 214, 215 to radiate outwards towards the direction of the listeners in the automobile. A layer of insulation 212 (e.g., foam or other sound-damping material) preferably matching the outer contours of the speakers 214, 215, as illustrated in FIG. 2B, may be placed within the speaker enclosure 201, so that the sound does not reflect on the back panel 231 (if any) of the speaker enclosure. In the resulting speaker enclosure configuration, sound emanating from the speakers 214, 215 is cleanly projected through the slot 219 to the listeners in the automobile. The layer of insulation 212 may have the benefit(s) in certain embodiments of preventing the creation of standing waves, and/or of minimizing the variation of sound output response with respect to frequency so that the speaker output can be readily equalized by, e.g., any standard techniques, including analog or digital equalization. For example, cascaded filter sections may be employed to tailor the frequency response of the speakers 214, 215 in discrete frequency bands so as to provide a relatively uniform overall frequency response.

The layer of insulation 212 may be comprised of any suitable material, preferably non-resonant in nature and having sound damping or absorbing qualities. The insulation 212 may, for example, be comprised of expanded or compressed foam, but may alternatively comprise rubber, reinforced paper, fabric or fiber, damped polymer composites, or other materials or composites.

In an alternative embodiment, the speakers 214, 215 may be directed upwards instead of downwards, with the slot 219 being located at the top of the speaker enclosure 201, to achieve a similar effect. The speakers 214, 215 may alternatively be positioned sideways, either facing towards are away from each other, with a pair of slots (one for each of the speakers 214, 215) being adjacent and vertical in orientation rather than horizontal, as with slot 219. In such an embodiment, the speaker enclosure may be taller but narrower in size.

In some circumstances, high frequencies (such as over 2 KHz) might become lost or reduced in the speaker enclosure configuration illustrated in FIGS. 2A-2C. Therefore, one or more additional speakers 217 of small size (e.g., tweeters) may be advantageously placed above the "bell" of the speakers 214, 215 and in the front panel 232 of the speaker enclosure 201, to radiate the higher frequencies.

While the speaker enclosure 201 shown in FIGS. 2A-2C has certain advantages for placement in a standard DIN space (or other similar or analogous space) of an automobile, it should be understood that the closely spaced speakers 114, 115, whether or not contained in a speaker enclosure 201, may be positioned in other areas of the automobile as well, such as atop the front dashboard, above the rear seatback, or in a center console or island located between the front seats or between the front and back seats. Preferably, the closely spaced speakers 114, 115 are located on or near the center axis of the automobile, so as to provide optimal sound quality evenly to occupants on both sides.

Because of space constraints within an automobile, the centrally located speakers (e.g., speakers 114, 115 in FIG. 1) may be of limited size. Smaller speakers, however, tend to suffer losses at low frequencies. To compensate for the loss of low frequency components where the central pair of speakers are small, left and right bass speakers (e.g., speakers 124, 125) may be provided in a suitable location—for example, built into the automobile doors. The left and right audio channels fed to the left and right door speakers can be processed to attenuate the mid/high frequencies and/or boost the bass audio components. Providing bass frequencies through the door speakers will not destroy the stereo effect of the mid/high frequencies provided by the central pair of speakers, since it is well known that low frequencies are not normally localized by the human listener.

In addition, as previously noted, a sub-woofer may be added in a suitable location within the automobile to further enhance very low frequency bass audio components. The sub-woofer may be located, for example, in the rear console of the car above the rear seatback, or in any other suitable location.

Various modifications may be made to provide even further improved sound for passengers in the back seat area. For example, a similar pair of closely spaced speakers to those placed in the front console or area can also be placed in the rear of the automobile, for example, atop the rear seatback on or in the rear parcel shelf, or at the back structure of the center island or console/armrest between the driver and passenger seats. The same signals that are used to feed the front pair of closely spaced speakers can be used to feed the rear pair of closely spaced speakers. If desired, a speaker enclosure 201, such as shown in FIGS. 2A-2C, containing the pair of closely spaced speakers may be placed in the rear of the vehicle to house these rear speakers.

Figure 9A:
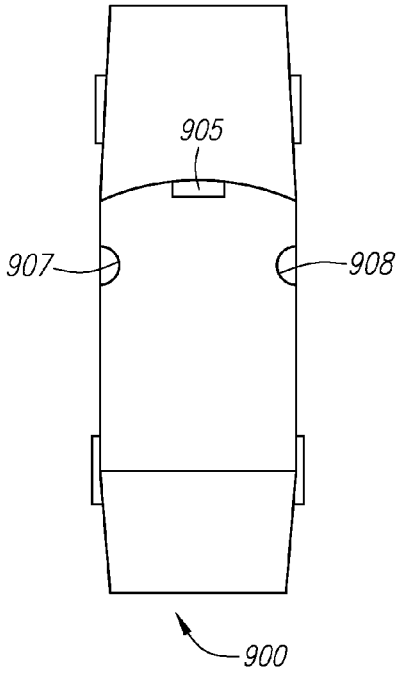
FIGS. 9A, 9B and 9C are diagrams illustrating possible placement of a pair of center speakers.
Figure 9B:
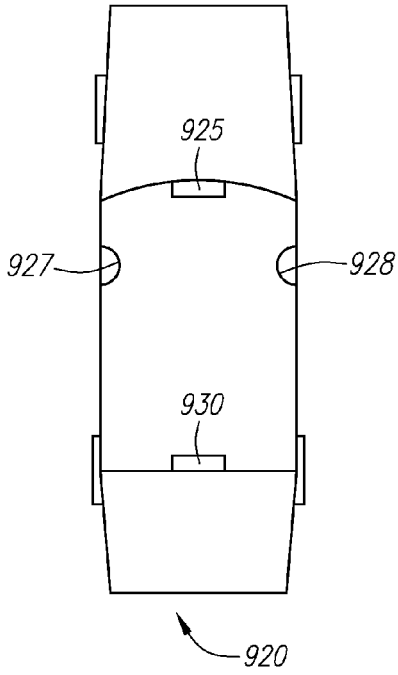
Figure 9C:
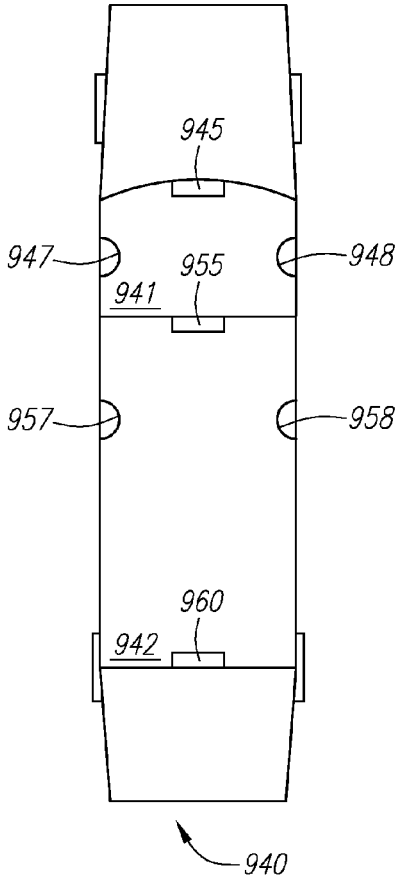

FIG. 9A is a simplified top view of an automobile 900 illustrating an example of placement of a pair of closely spaced speakers 905 (whether or not in a speaker enclosure) in the front section of the automobile 900 (e.g., in the front console or the front dash), with the addition of two door-mounted speakers 907, 908 for, e.g., providing added bass or low frequency audio components. FIG. 9B illustrates an example similar to FIG. 9A, but adding a pair of closely spaced speakers 930 (whether or not in a speaker enclosure) in the rear of the automobile 920. FIG. 9C illustrates an example of placement of speakers in a large vehicle such a limousine, with separate driver and passenger compartments. In the driver compartment 941, the layout is similar to FIG. 9A, with a pair of closely spaced speakers 945 in the front area (e.g., console, dash, or the like) of the vehicle 940, and pair of door-mounted left and right speakers 947, 948. In the passenger compartment 942, the layout is similar to FIG. 9B, with two pairs of closely spaced speakers 955, 960, one in the front area and one in the rear area of the passenger compartment 942, with a pair of right and left door-mounted speakers 957, 958 also. Of course, in any of these examples, any number of additional speakers and audio components may be added based upon individual need and preference, subject to spatial limitations of the vehicle, cost, etc.

In certain applications, it may be desirable to provide surround sound or other multi-channel capability in a vehicular automotive system, in conjunction with the closely spaced speaker arrangement described previously herein. For example, a van or other large vehicle may have a DVD system which allows digital audio-visual media to be presented to the passengers of the vehicle, with the sound potentially being played through the vehicle audio system. In other cases, it may be desirable to allow for extreme right and left directional sound, which may originate by the existence of left and right surround channels on the recorded medium, or simply by the presence of an extreme and intentional disparity in the relative volumes of the left and right channel.

Figure 11:
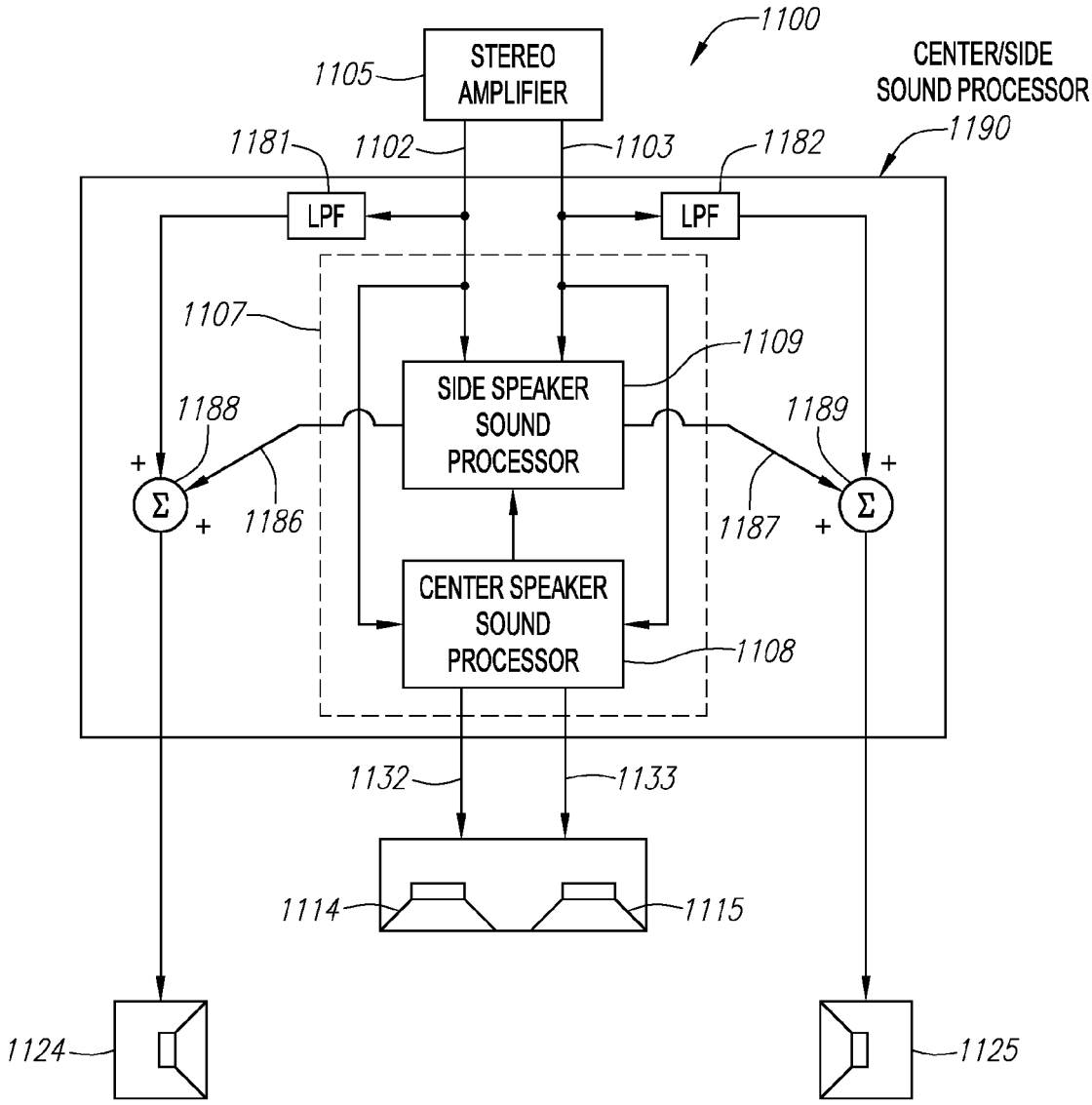
FIG. 11 is a block diagram illustrating an example of an automobile sound system for providing potentially improved extreme right/left sound, in connection with the pair of closely spaced center speakers.
Figure 12:
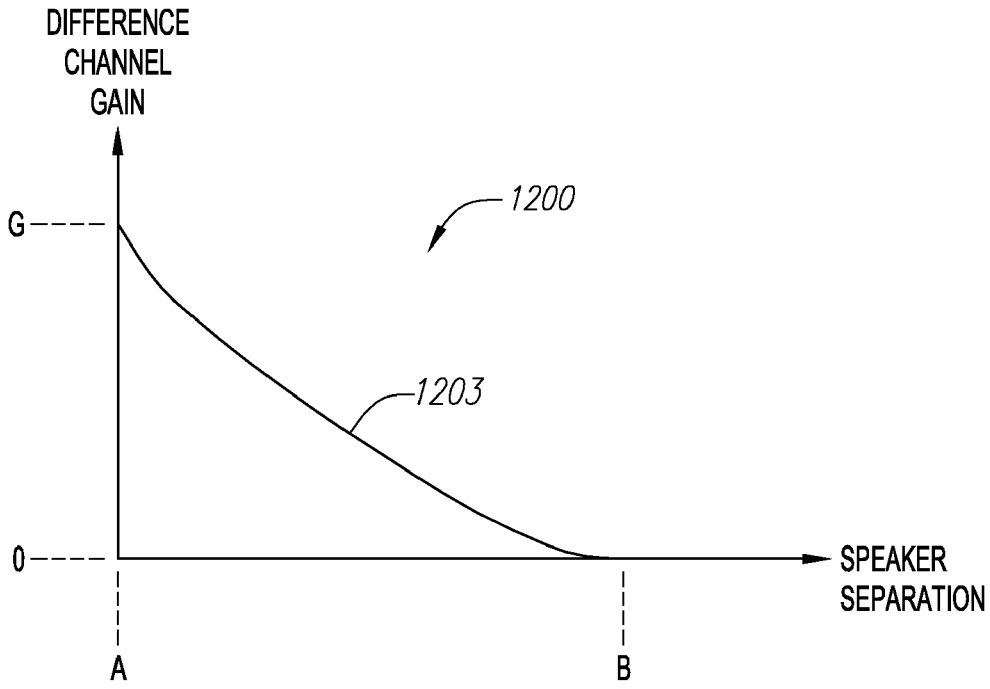
FIG. 12 is a graph illustrating a relationship between speaker separation in various embodiments as disclosed herein and difference channel gain.

A block diagram illustrating an example of an automobile sound system 1100 for providing potentially improved extreme right/left sound, in connection with the pair of closely spaced center speakers 1114, 1115, is illustrated in FIG. 11. The system 1100 shown therein operates much as described with the FIG. 1 sound system 100 with respect to the closely spaced center speakers 1114, 1115, producing the illusion of a widened stereo sound image for the occupants of the vehicle. In addition, the sound system 1100 illustrates the feed of left and right audio signals 1102, 1103 to left and right door-mounted speakers 1124, 1125, optionally through low pass filters 1181, 1182, respectively, to emphasize the bass tones (although the output of door-mounted speakers 1124, 1125 need not be limited to bass tones but could be, e.g., full range, and/or may be supplemented with additional left and right speakers).

To reinforce the impression of extreme left/right sound images, some portion of the left and right audio signals 1102, 1103 may be judiciously mixed into the left and right door-mounted speakers 1124, 1125 (or other left and right speakers if provided), with appropriate delays and/or level shifting, if desired, based upon the vehicle characteristics and design preferences. For example, some portion of the left and right audio signals 1102, 1103 (dictated by, e.g., a linear or non-linear function of the left and right signal strengths and/or their ratio or difference) may be mixed in to each of the signals fed into the left and right door mounted speakers 1124, 1125 (or other left and right speakers if provided). The left and right audio signals 1102, 1103 may be provided to an enhanced sound processor 1107 which includes both a center speaker sound processor 1108 and a side speaker sound processor 1109. The center speaker sound processor 1108 may generally operate according to various principles described elsewhere herein with respect to the generation of modified left and right audio signals 1132, 1133 fed to closely spaced center speakers 1114, 1115. The side speaker sound processor 1109 also receives the left and right audio signals 1102, 1103 and applies processing to reinforce the impression of extreme left/right sound images, based upon the content of the left and right audio signals 1102, 1103 indicative of extreme left or right sounds in the audio source material. The side speaker sound processor 1109 may also take account of or utilize signal information generated by the center speaker sound processor 1108. The side speaker sound processor 1109 injects extreme left/right audio reinforcement signals 1186, 1187 into the left and right audio channels, respectively, as conceptually illustrated in FIG. 11 through summing blocks 1188, 1189. An extreme left or right sound image can thereby be successfully reproduced in the left or right door-mounted speakers 1124, 1125 or other left or right speakers in the system.

Similar techniques for producing extreme left/right sound images may be applied to any of the other various embodiments described herein as well.

Figure 8:
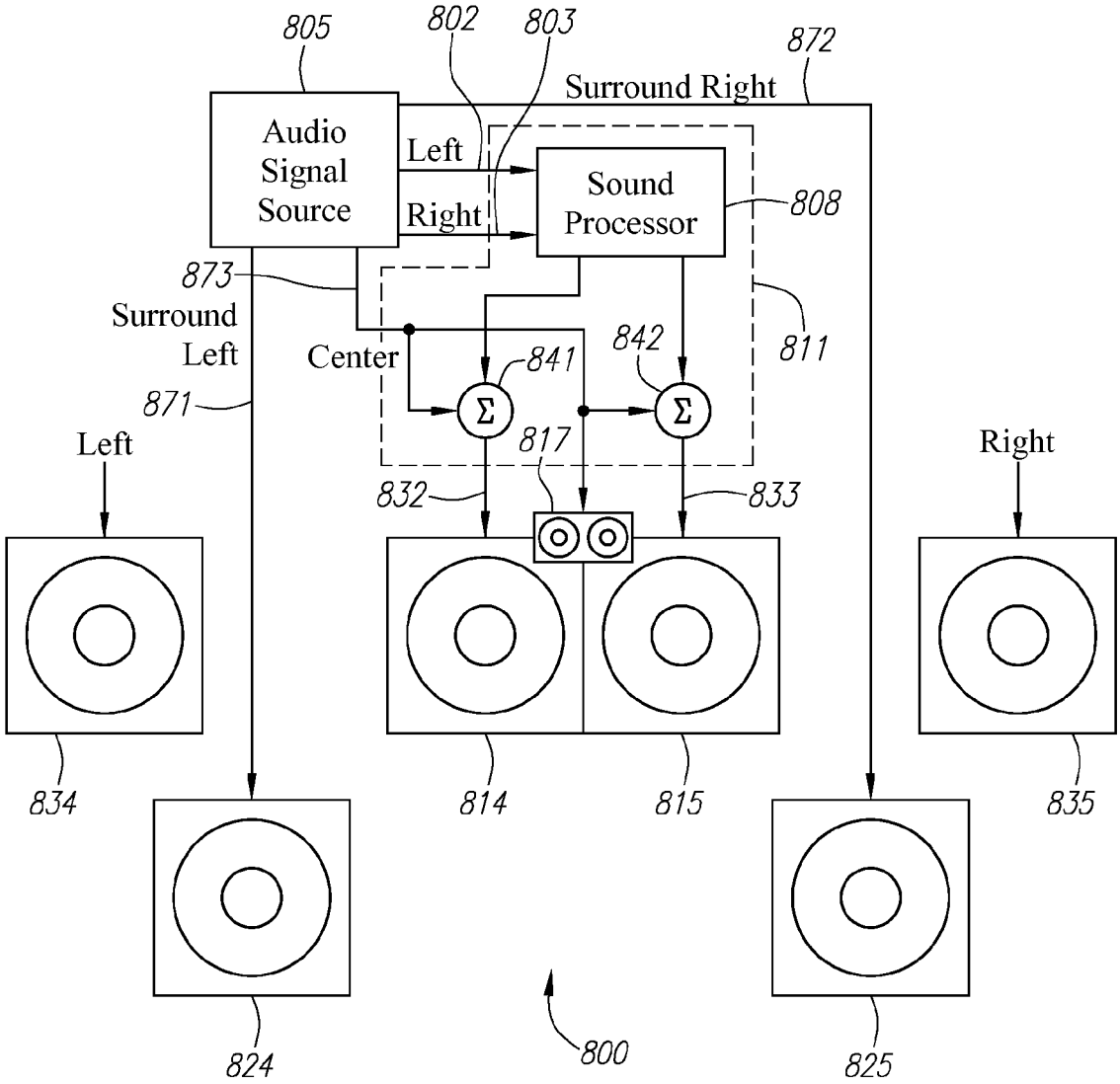
FIG. 8 is a diagram of a surround sound system for an automobile or other vehicle.

Another embodiment, directed to a surround or multi-channel sound system 800 as may be utilized in a vehicle, is illustrated in block form in FIG. 8. As shown therein, the sound system 800 may include an audio signal source 805 which provides a source for left and right audio channels 802, 803, which are fed to a sound processor 808 which functions in a manner similar to sound processor 108 shown in FIG. 1, or various other sound processor embodiments described herein with respect to closely spaced left/right central speakers. The left and right audio signals 802, 803 may, in the present example, comprise front left and front right audio signals of a surround sound formatted medium. A center audio signal of the surround sound formatted medium may be mixed into the signals 832, 833 provided to the closely spaced speakers 814, 815, and may also be provided to additional center speakers 817 (e.g., tweeters), if provided. The closely spaced speakers 814, 815 and additional speakers 817 may be embodied and arranged, for example, in the form of the speaker enclosure and arrangement illustrated in FIGS. 2A-2C. A surround left and surround right audio channel 871, 872 may be fed into surround left and right speakers 824, 825, which may be dipolar or monopolar in nature. The surround left and right speakers 824, 825 may be generally used to provide ambient sound. When the surround left and right audio channels 871, 872 are monaural in nature, adaptive decorrelation may be employed, as well understood in the art, to enhance the sense of ambience.

Left and right speakers 834, 835, which may be, e.g., door-mounted speakers, may be directly fed the left and right audio channels 802, 803, or else may be fed only the bass/low frequency tones, possibly mixed with extreme right or left sound components, such as described previously with respect to the sound system of FIG. 11.

In addition, the sound system 800 of FIG. 8 may further be provided with an additional pair of closely spaced speakers (not shown) located at the rear of the vehicle. The additional pair of closely spaced speakers may be fed the same processed left and right audio channel signals 832, 833 as provided to the front closely spaced speakers 814, 815, or may be fed similarly processed signals derived from the surround left and right audio channel signals 871, 872, or alternatively, surround back left and back right audio channel signals (not shown), if the audio product is encoded in a 7.1 surround or similar multi-channel format.

Figure 13:
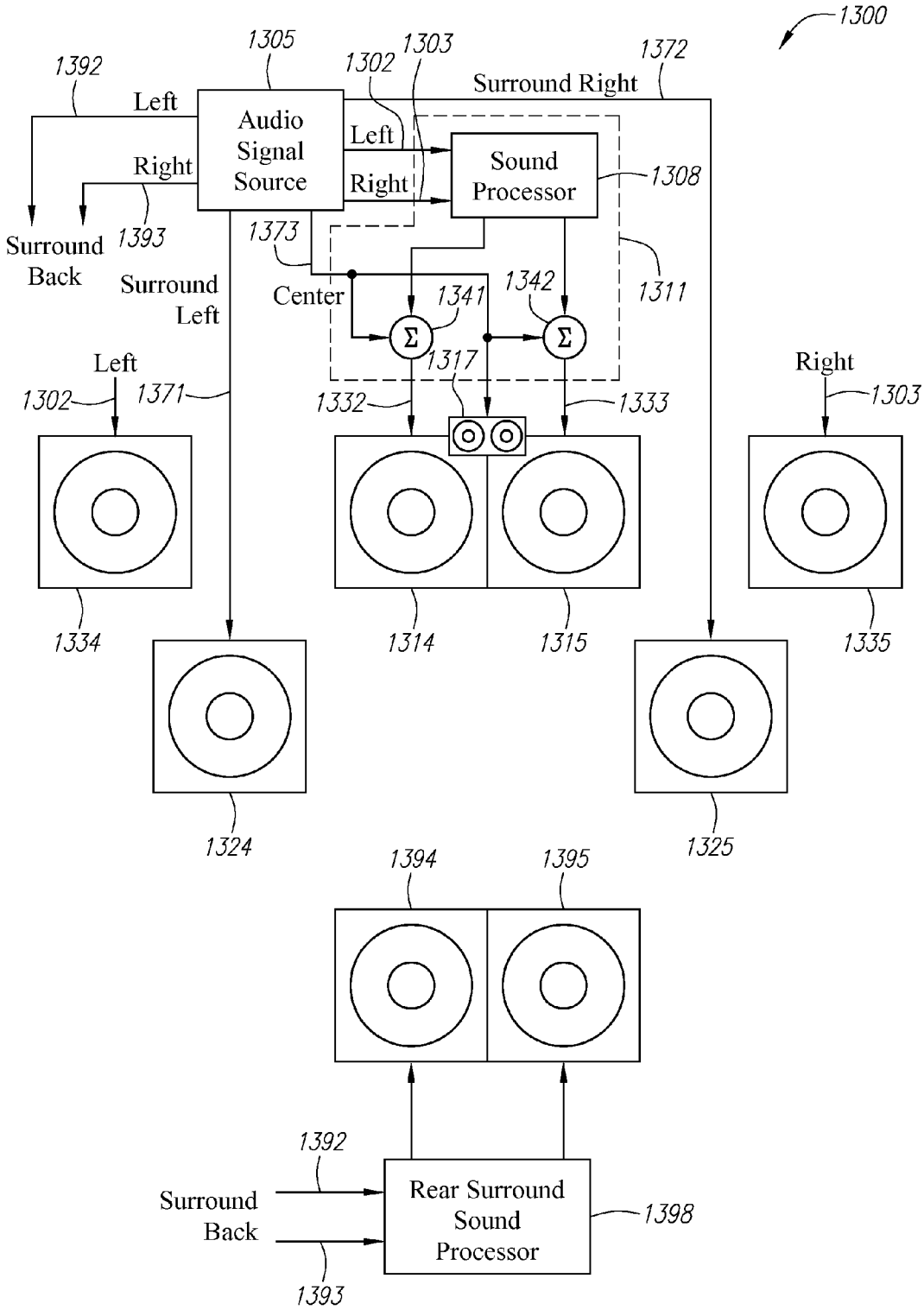
FIG. 13 is a diagram of another embodiment of a surround sound system for an automobile or other vehicle.
Figure 14A:
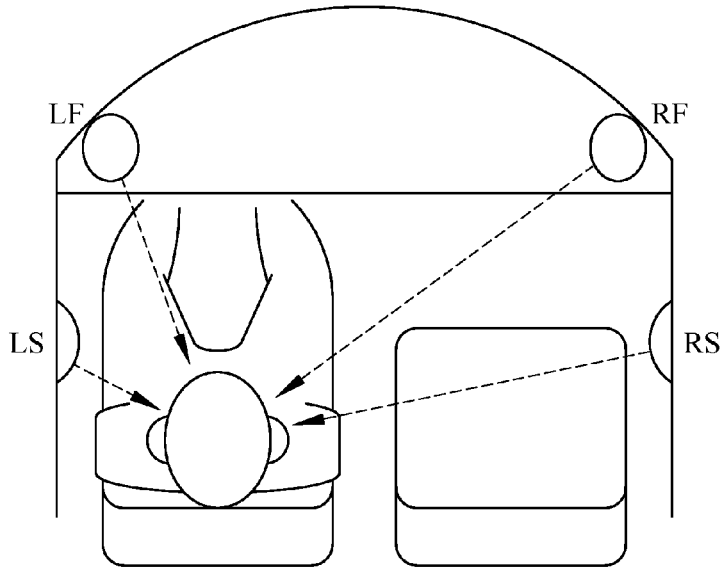
FIG. 14A (PRIOR ART)
FIGS. 14A and 14B are diagrams comparing the audio effect of speaker placement and sound processing between the prior art and various embodiments as disclosed herein.
Figure 14B:
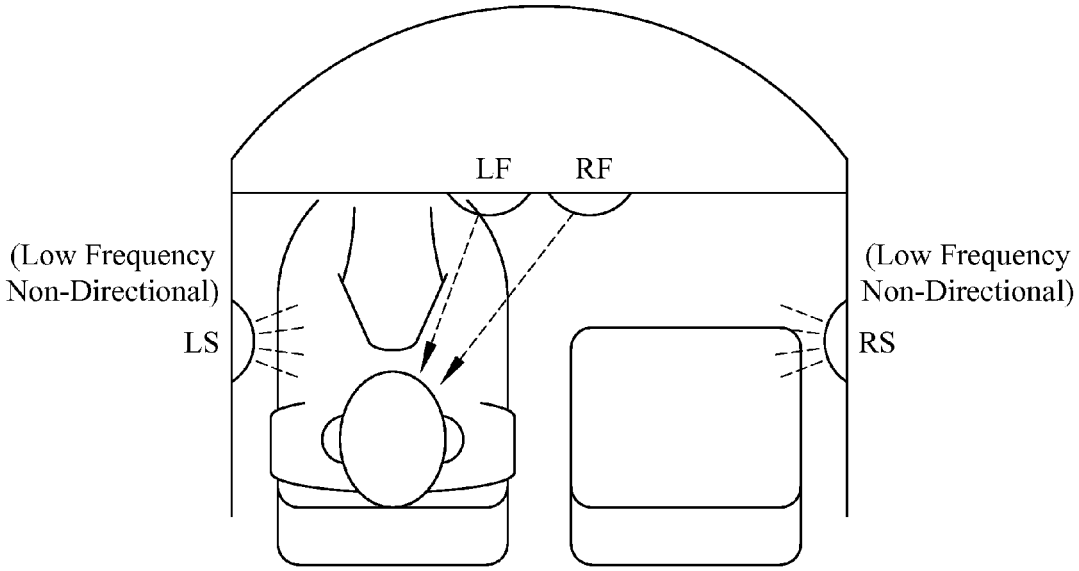

FIG. 13 is a diagram of a surround or multi-channel sound system 1300 similar to the sound system 800 shown in FIG. 8, but illustrating the presence of a pair (right and left) of closely spaced surround back speakers 1394, 1395. In the embodiment shown in FIG. 13, a rear surround processor 1398 receives as inputs two surround back channels 1392, 1393 provided from the audio signal source 1305. The rear surround processor 1398 preferably provides sound processing to the two surround back channels 1392, 1393 for the closely spaced rear surround speakers 1394, 1395 in a manner similar to that for the closely spaced front right/left speakers 1314, 1315, using any of the sound processing techniques described herein for closely spaced speakers. The sound processing for the surround back speakers 1394, 1395 need not be identical to that of the closely spaced front right/left speakers 1314, 1315, but may differ in terms of spectral weighting, gain, etc., to account for the fact that the surround back speakers 1314, 1315 may serve a different purpose to some degree than the front right/left speakers 1314, 1315.

The content of the surround back channels 1392, 1393 may depend upon the format of the encoded audio product. In 5.1 surround format, for example, the surround back channels 1392, 1393 may be the same as the right and left surround channels 1371, 1372. In 6.1 surround format, the surround back channels 1392, 1393 may be the same as the right and left surround channels 1371, 1372, added or mixed with the single surround back channel. In 7.1 surround format, the surround back channels 1392, 1393 are preferably the independent left and right surround back channels encoded in the audio product.

Figure 23A:
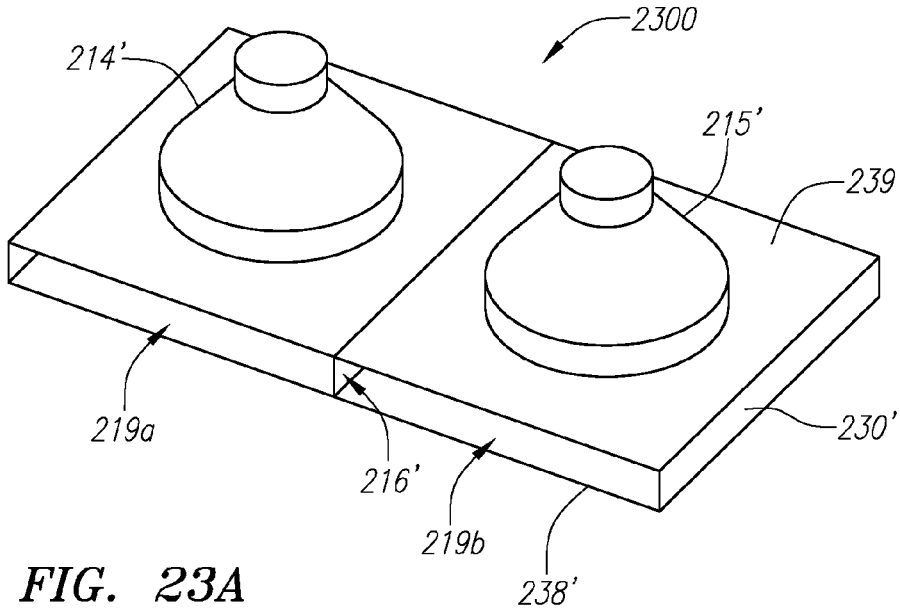
FIGS. 23A and 23B are oblique view diagrams comparing speaker mounting structures utilizing the general speaker arrangements of FIGS. 2A-2B and 19A-19B, respectively.

The mounting structure for the closely spaced speakers may take any of a wide variety of forms. In general, any mounting structure that provides adequate support for the closely spaced speakers (and possibly other components, including additional speakers, discrete electrical components, and/or printed circuit board(s)) and which forms a relatively narrow or constrained orifice for sound output from the closely spaced speakers may be utilized in the various embodiments as described herein. FIG. 23A, for example, is a diagram of a speaker mounting structure as may, for example, be used in connection with the speaker enclosure 200 illustrated in FIGS. 2A-2D, or else in other arrangements. In FIG. 23A, speakers 214' and 215' (which are generally analogous to speakers 214 and 215 illustrated in FIG. 2A) are mounted on a baffle comprising a speaker mounting plate 239 which, in this example, forms a top surface of sound ducts or channels associated with speakers 214' and 215', respectively. Along with the speaker mounting plate 239, a sound reflecting plate 238', side plates 230', an optional center divider 216', and a back plate (not shown) generally define the sound ducts or channels which output sound from slots 219*a* and 219*b*. The baffle (speaker mounting plate 239) serves to reduce interference between sound radiated from the front and rear of the speakers 214', 215'. As indicated previously, with respect to, e.g., FIG. 2B, compressed or expanded foam, or other sound-damping material, may be placed within portions of the sound ducts to help guide the sound output in the desired direction while reducing undesirable artifacts and acoustic interference.

In certain applications, it is preferred that the other interior surfaces of top plate 239, bottom plate 238' or side plates 230' are constructed of a rigid and substantially non-resonant material such as molded or high-impact plastic, pressed steel, aluminum, ceramics, and the like, or composite materials such as mica- or glass-reinforced plastic. The top plate 239, bottom plate 238' and side plates 230' are preferably thin to minimize the space needed for the speaker unit assembly 2300. Likewise, the center divider 216', if provide, may also be constructed of a rigid and substantially non-resonant material.

Figure 19A:
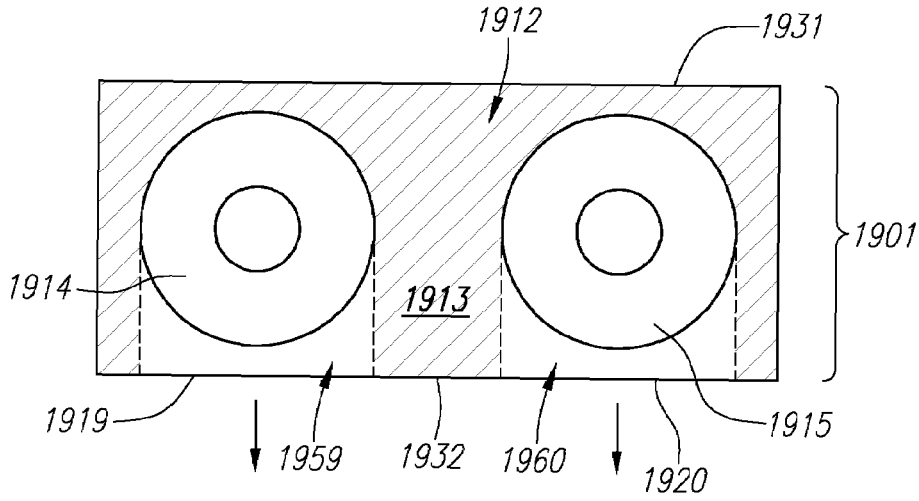

The rigid and substantially non-resonant interior surfaces of the sound ducts or channels are helpful in propagating the acoustic waves generated by speakers 214', 215' through the ducts or channels and out of output slots 219*a* and 219*b* while minimizing losses due to absorption, but may also in some cases cause undesirable interference, cancellation, standing waves, or acoustic artifacts. The embodiment illustrated in FIG. 19A is designed in one aspect to mitigate these potential problems. FIG. 19A is a cutaway top view diagram of a speaker mounting structure, similar in certain respects to FIG. 2B. As shown in FIG. 19A, sound-damping material 1912 is extended to the front 1932 of the speaker mounting structure 1901, thereby forming sound ducts 1959, 1960 associated with each of the two speakers 1914, 1915.

Figure 19B:
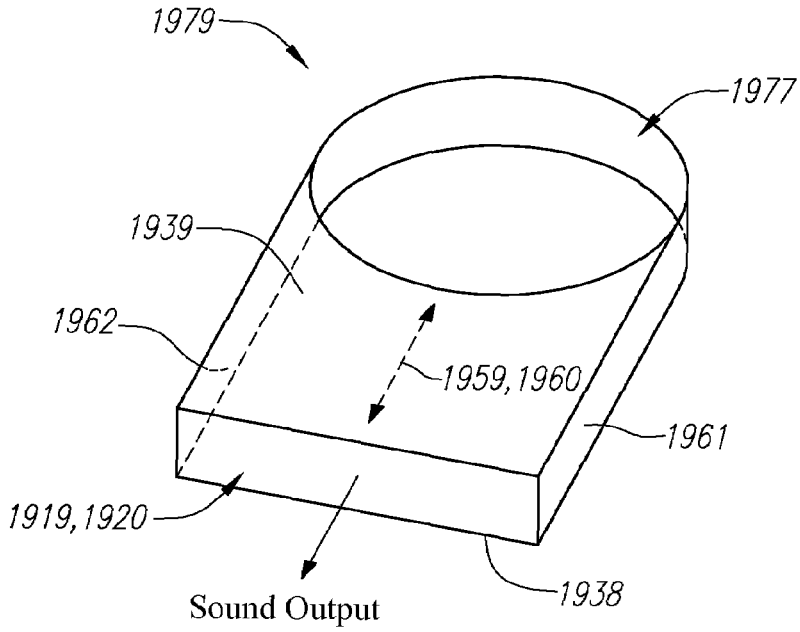
FIG. 19B is a detail diagram of a portion of FIG. 19A.

FIG. 19B shows the general dimensions of sound duct 1959 or 1960, with portions of the speaker mounting plate 1939 and sound reflecting plate 1938 defining two surfaces of the sound duct 1959 or 1960, and two sides 1961, 1962 of the sound duct 1959 or 1960 being defined by the edge of the sound-damping material 1912 (shown in FIG. 19A). An opening in the speaker mounting plate 1939 (i.e., baffle) permits placement of the speaker 1914 or 1915 thereon. In one aspect, the sound duct 1959 or 1960 effectively "turns" the sound output by the speaker 1914 or 1915 by 90° (in this example), so that the sound is carried to the output slot and released while retaining a sufficient degree of sound quality, and, similar to a number of other embodiments described herein, modifies the effective shape of the speaker output from an elliptical or circular radiator to a rectangular radiator. In addition, the total radiating surface area can be advantageously reduced, as compared to the radiating surface area of the speakers themselves, minimizing the space needed in the vehicle dash or other locations of the vehicle or other environment. Moreover, the aspect ratio of the output slot can be adjusted or tailored to modify the directional characteristic of the acoustic output in order to, for example, make the sound image broader along a particular axis, thus improving sound quality at off-axis listening positions.

The sound duct(s) 1959, 1960 may, in alternative embodiments, be slightly or moderately ascending or descending, or else the passage or duct may be semi-curved, such that the direction of the sound output is modified. Also, in various embodiments, the output slot may flare outwards or else may have other variations in size, shape (e.g., may be ovoid), and uniformity.

As illustrated in FIGS. 19A and 19B, the sound ducts 1959, 1960 may be of substantially the same width as the cones of the speakers 1914, 1915, and may provide a superior mechanism for transporting the acoustical output of the speakers 1914, 1915 through the output slots 1919, 1920, respectively, as compared, for example, with a rectangular duct having only hard and reflective surfaces. Variations in the size and shape of the sound ducts 1959, 1960, as noted above, may be made while still achieving superior or at least acceptable sound output quality.

Like the central partition 216 (FIGS. 2A-2C) or 216' (FIG. 23A), the central strip or section 1913 of the sound-damping material 1912 may help prevent interference between the acoustic output of the left and right speakers 1914, 1915, provided that the sound-damping material 1912 in the central strip or section 1913 is dense enough to effectively isolate the sound ducts 1959, 1960 from one another. The central strip of section 1913 of the sound-damping material 1912 may further provide the advantage of eliminating or lessening the severity of standing waves that could, in certain embodiments, develop due to the particular shape or nature of the sound ducts 1919, 1920, and the presence of a more sound-reflective central partition. The sound-damping material 1912 preferably has sufficient acoustic absorption so as to reduce or eliminate the possible buildup of standing waves. By eliminating a more reflective central partition (such as 216 in FIGS. 2A-2C or 216' in FIG. 23B) and replacing it with a central strip or section 1913 of sound-damping material 1912, the effective width of the central strip or section 1913 can be effectively doubled (as compared to simply adding sound-damping material to either side of the central partition 216 or 216'), thus potentially improving its ability to counteract the buildup of standing waves. Moreover, the sound-damping material 1912 in its entirety preferably helps minimize the variation of sound output response with respect to frequency so that the output of speakers 1914, 1915 can be readily equalized by, e.g., any standard techniques, including analog or digital equalization. For example, cascaded filter sections may be employed to tailor the frequency response of the speakers 1914, 1915 in discrete frequency bands so as to provide a relatively uniform overall frequency response.

Figure 23B:
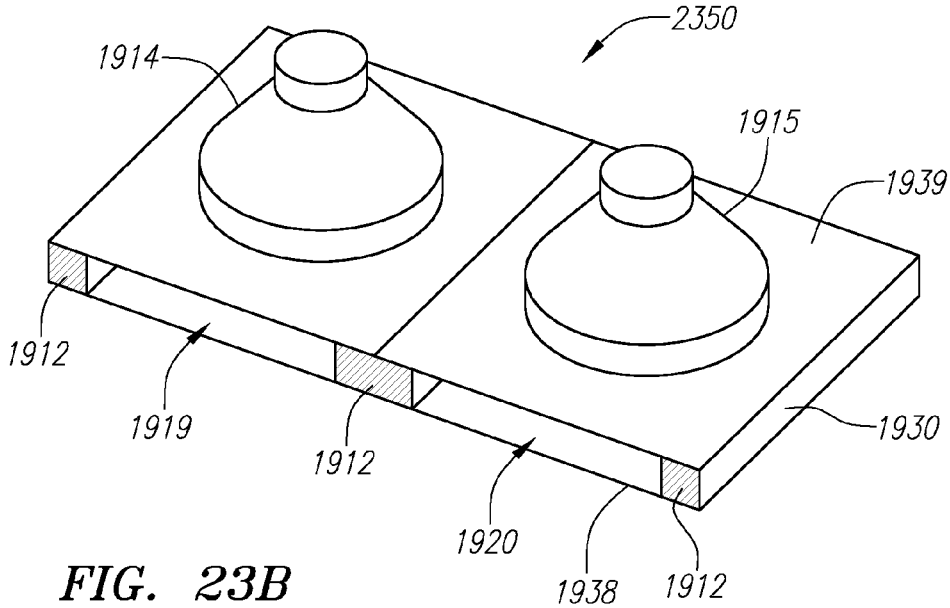

FIG. 23B illustrates one particular embodiment of a speaker mounting structure in accordance with certain principles described with respect to FIGS. 19A and 19B. As illustrated in FIG. 23B, speakers 1914, 1915 may be disposed on a baffle comprising speaker mounting plate 1939 (which is a top plate in this example). A sound reflecting plate 1938 (the bottom plate in this example) is positioned in a generally parallel orientation with respect to the speaker mounting plate 1939, and is separated therefrom by a layer of sound-damping material 1912 such as compressed foam. Rigid side panels 1930, or alternatively struts or other rigid members along the sidewall regions and/or, if desired, within the sound-damping material 1912, may optionally be provided for mechanical support. The front of speaker mounting structure illustrated in FIG. 23B may be compared against that shown in FIG. 23A, which does not show sound-damping material extending substantially to the front of output slots 219*a*, 219*b*.

A speaker system in accordance with principles and concepts as disclosed herein may include more than two speakers. Various embodiments, for example, utilize multiple speakers in each of the left and right channels, with the multiple speakers in each channel outputting sound through a common sound duct or channel and out an orifice (such as an aperture or slot). Examples of such embodiments are illustrated in FIGS. 17A-17C, 20, and 22. In the embodiment shown in FIGS. 17A and 17B, multiple (two in this example) speakers 1714*a*, 1714*b* are disposed in series along a sound duct 1759 on one side of the speaker mounting structure 1701, and, likewise, multiple (two in this example) speakers 1715*a*, 1715*b* are disposed in series along a sound duct 1760 on the other side of the speaker mounting structure 1701. In effect, each of the left and right audio channels has multiple speakers, which may provide advantages such as, for example, increased output capacity, different frequency ranges for different speakers, or other advantages. Similar to the embodiment illustrated in FIG. 19, sound-damping material 1712 such as compressed foam surrounds the rear contours of the speakers 1714*a* and 1715*a* furthest from the output slots 1719, 1720, and extends to the front 1732 of the speaker mounting structure 1701 so as to form left and right sound ducts 1759, 1760. The sound ducts 1759, 1760 are preferably (but not necessarily) of substantially uniform width, generally matching the width of speakers 1714*a*, 1714*b* and 1715*a*, 1715*b*. The speakers 1714*a*, 1714*b*, 1715*a*, 1715*b* may be of identical size and audio characteristics, or else, in alternative embodiments, may be of different sizes, shapes, and/or audio characteristics.

Figure 17A:
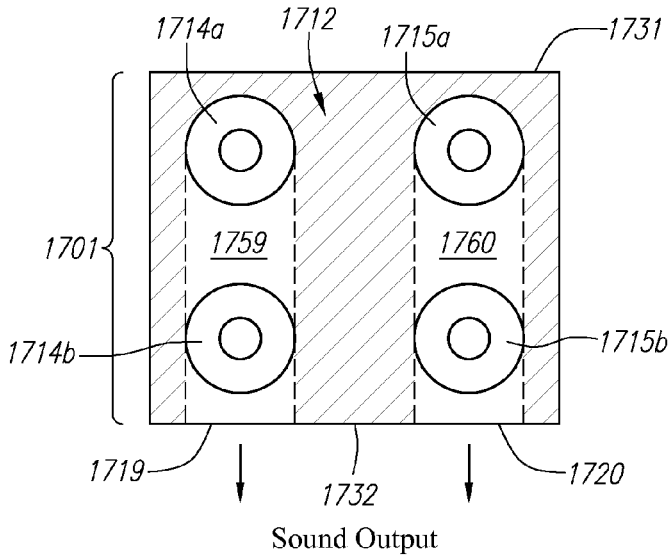
FIGS. 17A and 17B are diagrams of a speaker arrangement as may be used, for example, in connection with a speaker mounting structure or enclosure for providing sound output through an orifice.
Figure 17B:
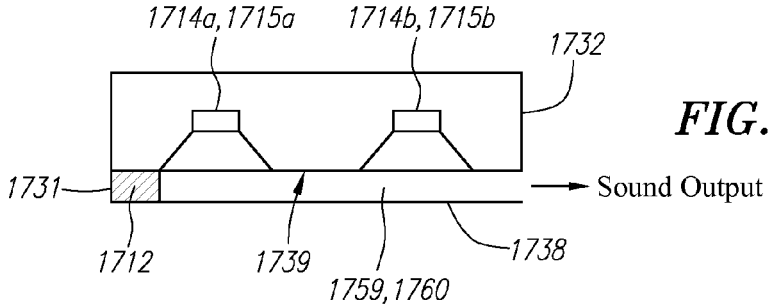

FIG. 17B illustrates a cutaway side view of the speaker mounting structure 1701 shown in FIG. 17A, with speakers 1714*a* (or 1715*a*) and 1714*b* (or 1715*b*) shown in side profile. The speakers 1714*a*, 1714*b*, 1715*a*, 1715*b* are mounted upon a baffle comprising a speaker mounting surface 1739. The speaker mounting surface 1739 and a sound reflecting surface 1738, which are preferably rigid and substantially non-resonant in nature, define sound ducts 1759, 1760 and allow propagation of the acoustic output of speakers 1714*a*, 1714*b*, 1715*a*, 1715*b* through output slots 1719, 1720. The shape of the sound-damping material 1712, generally in this example following the rear contours of the furthest speakers 1714*a*, 1715*a* from the output slots 1719, 1720, tends to improve the quality of the output sound by preventing expansion of the sound waves in a rearward direction, and thereby reducing potential interference or other undesirable acoustic effects. While FIG. 17B shows an enclosure surrounding speakers 1714*a*, 1714*b*, 1715*a*, 1715*b*, such an enclosure is not necessary and can be omitted.

In some situations, depending in part upon the size and shape of the sound ducts 1759, 1760 and the nature of the audio material, it may be possible for standing waves to develop within the sound ducts 1759, 1760 which adversely impact the quality of the audio output. The particular dimensions of the sound ducts 1759, 1760 and length, width, and/or thickness of the sound-damping material 1712 can be optimized by experimentation in order to yield the optimal sound quality for a given type of speakers 1714*a*, 1714*b*, 1715*a*, 1715*b*, a given audio track or type of audio material, compositions or materials used to form the speaker mounting structure (such as those used to form the rigid interior surfaces and/or the sound-damping material), and so on, by eliminating cross-modes and lengthwise modes associated with standing waves in the sound ducts 1759, 1760.

Figure 17C:
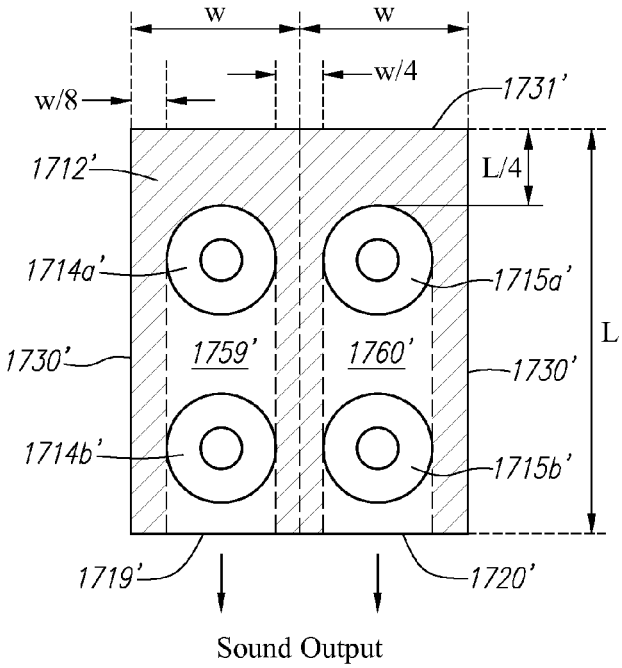
FIG. 17C is a particular variation thereof illustrating preferred dimensions of sound-damping material according to one example.

FIG. 17C illustrates an example of preferred dimensions for the sound-damping material 1712' where four speakers 1714*a'*, 1714*b'*, 1715*a'*, and 1715*b'* are used in speaker assembly of the type generally illustrated in FIG. 17A. As shown in FIG. 17C, the amount of sound-damping material 1712' that is placed to either side of a sound duct 1759' or 1760' may be approximately W/8, where W represents the outer width boundaries of the sound-damping material 1712' for a given channel. With two channels, the sound-damping material 1712' may be combined in the center portion between the two sound ducts 1759', 1760', yielding a collective width of approximately W/4, as illustrated in FIG. 17C. Similarly, the amount of sound-damping material 1712' that is placed at the rear of each sound duct 1759', 1760' may be approximately L/5 to L/4, where L represents the outer length boundaries of the sound-damping material 1712' for a given channel (assuming the sound-damping material 1712' extends to the edge of slots 1719', 1720').

The particular dimensions illustrated in FIG. 17C are simply representative of one example. In practice, it may be expected that good results with respect to sound quality may be obtained over ranges of different widths of sound-damping material 1712' placed to either side of a sound duct 1759' or 1760' and to the rear of the further speakers 1714*a'*, 1714*b'* from the slots 1719', 1720'. Moreover, similar parameters may be applied, as appropriate, to embodiments having a single row of speakers such as the one shown in, e.g., FIG. 19A.

Returning to FIGS. 17A and 17B, the thickness of the sound-damping material 1712 is preferably sufficient to fill the volume (except for the sound ducts) between the surface mounting plate 1739 and sound reflecting plate 1738 without gaps that might cause cross-mode interference or the creation of sound artifacts, and thus may generally be dictated by the distance of separation of the surface mounting plate 1739 and the sound reflecting plate 1738. Typically, the thickness of the sound-damping material 1712 might be in the range of, e.g., ½" to 1" thick, although the thickness may vary depending upon the size and shape of the relevant portions of the speaker mounting structure 1701.

While the size and shape of the sound ducts 1759, 1760 and output slots 1719, 1720 may vary depending upon the particular design preferences for the vehicle sound system, there may be physical or practical limitations to how narrow the sound ducts 1759, 1760 or output slots 1719, 1720 may be made. Narrowing of the sound ducts 1759, 1760 or output slots 1719, 1720 may decrease the efficiency of the speakers (which may be compensated by larger speakers and/or increased drive power), and may cause audible noise from turbulence. Therefore, the narrowness of the sound duct or slot size may be limited by, among other things, impedance losses that cannot be made up by increased drive power and the onset of sound artifacts or noise caused by turbulence or nonlinear airflow.

While the embodiment illustrated in FIGS. 17A-17C shows two speakers in series for each channel, the same principles may be extended to any number of speakers in series in each speaker channel.

Figure 20:
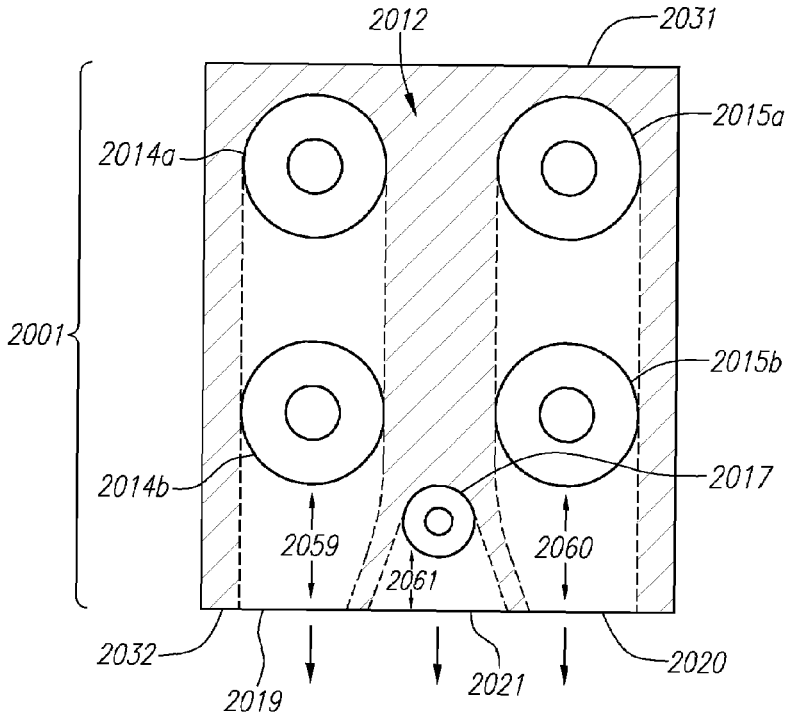
FIG. 20 is a cutaway top-view diagram of another speaker arrangement similar to FIG. 17A but adding an additional speaker.

FIG. 20 is a cutaway top-view diagram of another speaker arrangement similar to FIG. 17A but adding an additional speaker. The layout of the speaker mounting structure 2001 shown in FIG. 20 is similar to that of FIG. 17A, with "rear" speakers 2014*a*, 2015*a* and "front" speakers 2014*b*, 2015*b* placed over left and right sound ducts 2059 and 2060 as illustrated. An additional speaker 2017, such as, e.g., a domed tweeter, is added between the left and right sound ducts 2059, 2060, and the sound-damping material 2012 (e.g., compressed or expanded foam) is preferably formed so as to define a central sound duct 2061, which in this example is relatively short. In the case where the additional speaker 2017 is a tweeter or else handles significant high frequency signal components, it is generally desirable to place the speaker 2017 as near to the output slot 2021 as possible. The additional speaker 2017 may have a relatively narrow output slot 2021, for example, 6-8 millimeters in height. Where available space is a concern, or where it is desired to achieve certain specific dimensions of sound-damping material surrounding the left and right sound ducts 2059, 2060, the sound ducts 2059, 2060 may be tapered slightly towards the sound output slots 2019, 2020 in order to accommodate the central sound duct 2061. In alternative embodiments, the sound ducts 2059, 2060 may not be tapered. The central sound duct 2061 may flare outwards as it extends towards the central output slot 2021 so as to provide a relatively broad directional characteristic.

One potential advantage of using speaker output slots 2019, 2020, and 2021 (and similar configurations in other embodiments disclosed herein), is that the effective radiation sources of the speakers can be brought closer together, leading to a cleaner, smoother sound image both on and off axis, and reducing the potential for destructive interference or other undesirable sound distortion due to perceptible time delays between the left and right acoustic output. Moreover, in certain embodiments, the perceptible sound output may be stable and not fall off at relevant frequencies regardless of the listener's relative position along the narrower axis of the slot(s) 2019, 2020 and 2021 (or at least not until approximately 90 degrees off angle), such that the speaker system provides uniform and wide coverage of substantially all the listening area in a near omnidirectional manner.

Figure 21:
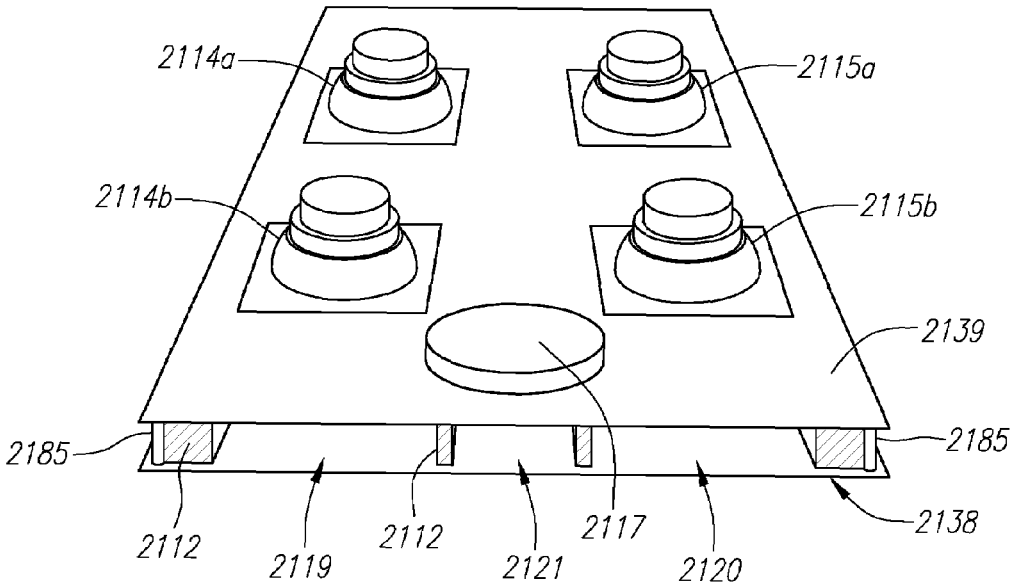
FIG. 21 is an oblique view diagram of the speaker arrangement of FIG. 20, illustrating one possible embodiment of a speaker mounting structure associated therewith.

FIG. 21 is an oblique view diagram in general accordance with the speaker arrangement of FIG. 20, illustrating one possible embodiment of a speaker mounting structure associated therewith. As shown in FIG. 21, a baffle comprising a speaker mounting plate 2139 may define several openings for placement of various the speakers 2114*a*, 2114*b*, 2115*a*, 2115*b* (and optionally 2117). The speaker mounting plate 2139 may be physically attached to a sound reflecting plate 2138 by multiple struts 2185 placed at, e.g., the corners and/or along the sides of each of the speaker mounting plate 2139 and the sound reflecting plate 2138. Advantageously, a compressable sound-damping material 2112, such as foam, may be placed between the speaker mounting plate 2139 and the sound reflecting plate 2138 and compressed therebetween. To facilitate compression of the sound-damping material 2112, the struts 2185 may take the form of threaded bolts which may be screwed into threaded holes (not shown) aligned in the speaker mounting plate 2139 and sound reflecting plate 2138. Tightening the threaded bolts has the effect of compressing the sound-damping material 2112. As previously described, the sound-damping material 2112 may be used to form sound ducts for the speakers 2114*a*, 2114*b*, 2115*a*, 2115*b*, 2117 which terminate in sound output slots 2119, 2120, and 2121 as shown. A similar technique for constructing a speaker mounting structure may be applied to the various other embodiments described herein, including for example, those illustrated in FIGS. 2A-2B and 17A-17C, or others.

Figure 22:
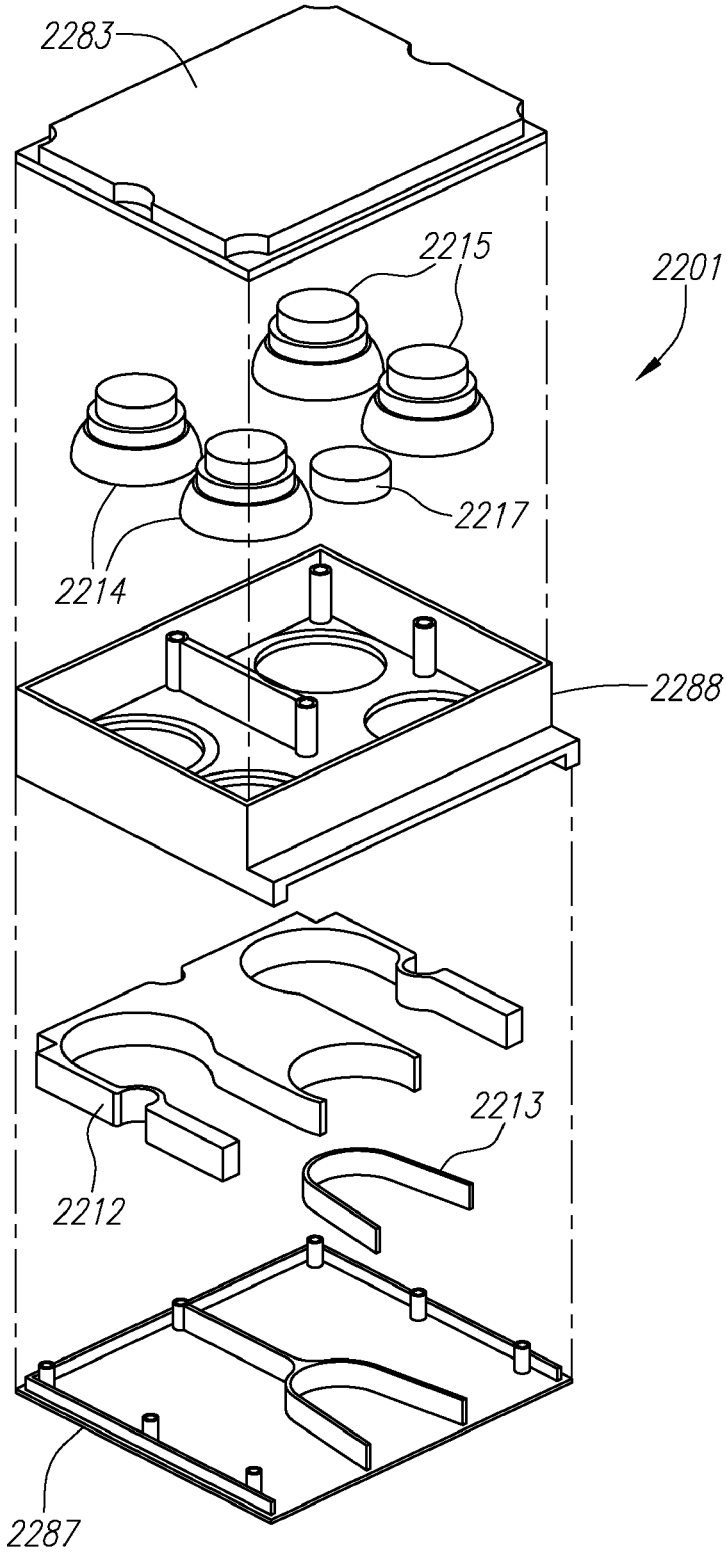
FIG. 22 is an assembly diagram of a speaker mounting structure utilizing a general speaker arrangement such as shown in FIG. 20.

FIG. 22 is an assembly diagram of a speaker unit 2201 utilizing a general speaker arrangement such as shown in FIG. 20. As illustrated in FIG. 22, the speaker unit 2201 includes a baffle comprising a speaker mounting structure 2288 which has several openings for placement of speakers 2214, 2215 (and optionally 2217). In this particular example, the speaker mounting structure 2288 has a speaker mounting plate around the periphery of which are walls surrounding the speakers 2214, 2215, 2217, but such walls may not be necessary or desired in other embodiments. A sound reflecting plate 2287 is configured to generally match the bottom dimensions of the speaker mounting structure 2288. Sound-damping material 2212, 2213 may be preformed in one or more pieces to define sound ducts for the various speakers 2214, 2215, 2217, and is preferably compressed or expanded between sound reflecting plate 2287 and the speaker mounting enclosure 2288. In this particular example, a speaker enclosure ceiling 2283 is adapted for placement atop the speaker mounting structure 2288, thereby forming a speaker enclosure. The speaker enclosure ceiling 2283 may have multiple holes through which, e.g., threaded bolts may be inserted for ultimate securing to the sound reflecting plate 2287, which may have threaded holes in matching alignment with the holes in the speaker enclosure ceiling 2283. As previously described, tightening of the threaded bolts may advantageously provide compression of the sound-damping material 2212, 2213.

Figure 24:
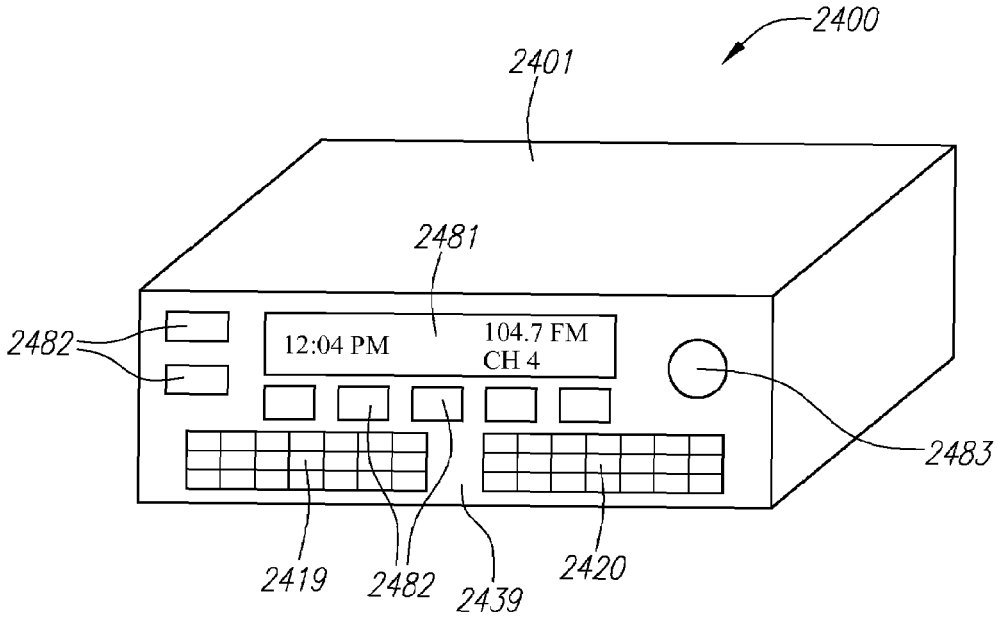
FIG. 24 is a diagram illustrating an example of stereo unit including internal speakers and output slots for sound radiation.

With the speaker unit 2201 of FIG. 22, or with other embodiments described herein, it may be desirable to package one or more speakers, sound processing electronics or components for the speakers, and, if desired, other electronics (such as a receiver, amplifiers, onboard computer, etc.) in a single discrete unit that may be conveniently installed in a vehicle as, e.g., a substitute for a vehicle's existing in-dash stereo unit. FIG. 24 is a diagram showing an example of a stereo unit 2400 adapted for convenient installation in a vehicle. In the example of FIG. 24, the stereo unit 2400 includes an enclosure 2401 housing two or more internal speakers (not shown) which radiate sound via output slots 2419 and 2420 (illustrated with speaker grills which may be added for aesthetic purposes). Internally, the stereo unit 2400 may contain, e.g., two speakers with foam-surrounded sound ducts similar to the arrangement illustrated in FIG. 19A and/or 23B. On any available space of a front panel 2439 of the stereo unit 2400 may be placed a display 2481 and various controls, buttons and/or knobs 2482 and 2483 which may be found on conventional in-dash stereo units. In addition to the speakers, the stereo unit 2400 may contain electronics such as a receiver, amplifier(s), equalizers, sound processing components, etc., to provide the functionality of an in-dash stereo unit. The enclosure 2401 of the stereo unit may be of appropriate dimension to fit within a standard (single or double) DIN slot or other similar or analogous space, to allow convenient substitution of a vehicle's existing stereo unit. The stereo unit 2400 may also have various electrical connections or ports (not shown) to allow electrical connection to external speakers or other electronic components in the vehicle.

It should be emphasized that, while various embodiments have been illustrated in the drawings with the speakers positioned or mounted on the apparent "top" of the speaker mounting assembly or speaker enclosure, the speaker mounting assembly may be placed in any desired orientation. Thus, where terms such as "top" and "bottom" or "left" and "right" are used herein, they are not meant to convey absolute orientation but rather relative orientation with respect to a reference frame that may be rotated or otherwise manipulated. The speaker mounting assembly may be placed in any suitable orientation such that, for example, the sound output slots are vertical rather than horizontal, or the speaker mounting surface is below the sound reflecting surface.

Where speakers are placed in series such as shown, for example, in the embodiments illustrated in FIGS. 17A-17C, 20, and 21, interference between the speakers may occur due to the fact that the "front" speakers (e.g., 1714*b*, 1715*b*) are closer to their respective output slots (e.g., 1719, 1720) than the "rear" speakers (e.g., 1714*a*, 1715*a*). As a result, sound from the rear speakers takes longer to propagate down the sound duct and emanate out of the output slot than with the front speakers. Because the acoustic output from the front and rear speakers are delayed relative to one another, the sound waves can interfere and lead to destructive cancellation of as much as 10 dB or possibly more, or other anomalies. In order to prevent the "delayed" output from the rear speakers causing destructive interference with the output from the front speakers or other undesirable effects, it may be desirable to add a delay to the drive signal feeding the front speakers, such that the sound output is synchronized relative to the output slot. In addition to delaying the signal to the forward speakers 1714*b*, 1715*b*, the power level for the rearward speakers 1714*a*, 1715*a* may be increased.

Figure 18:
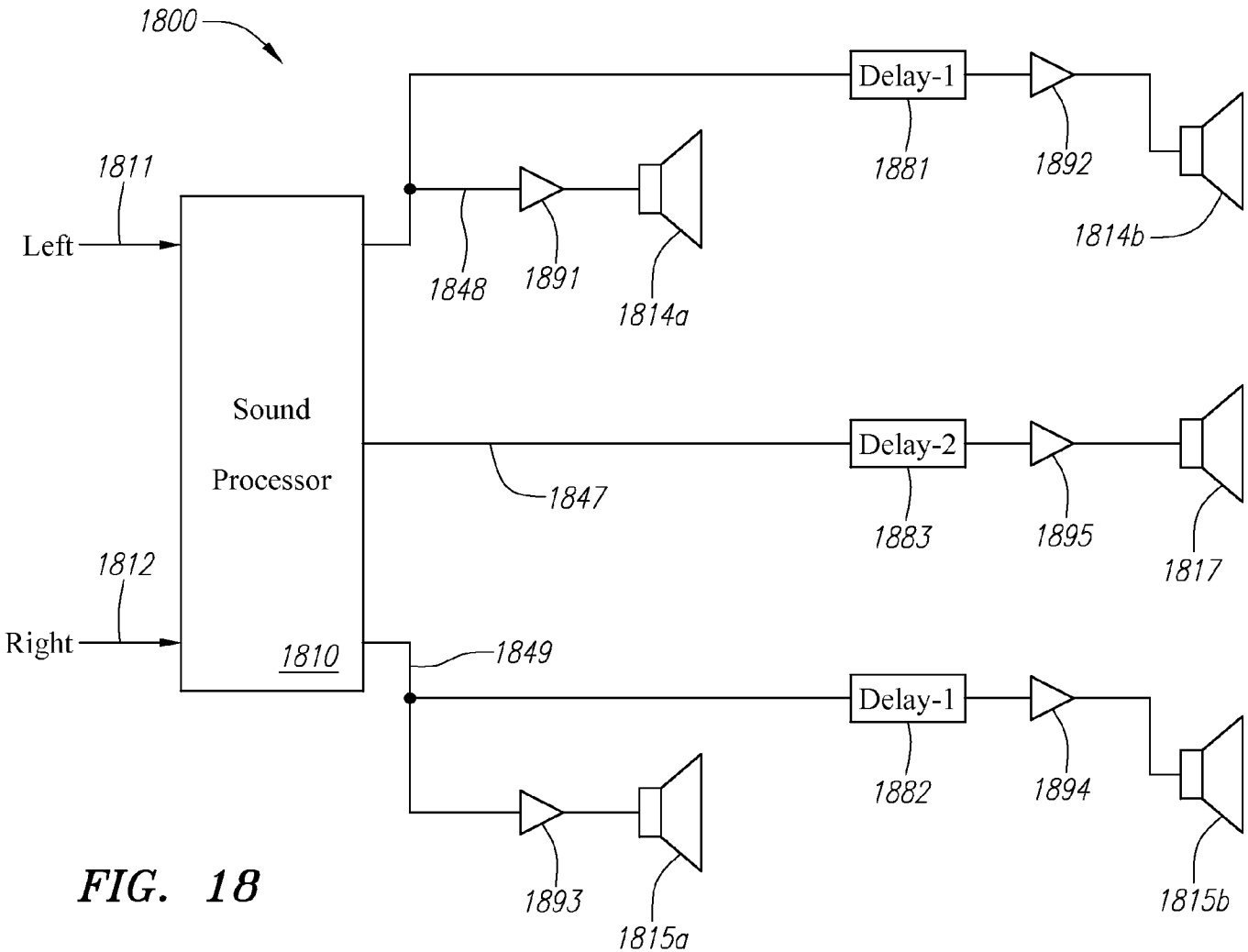
FIG. 18 is a simplified circuit diagram for the speaker arrangement of FIGS. 17A and 17B, wherein delays are used to synchronize sound output through the orifice.

FIG. 18 is a simplified diagram of a circuit 1800 that may be used in, e.g., the speaker arrangements of FIGS. 17A-17C or FIG. 20, wherein delays are used to synchronize sound output between the front and rear speakers relative to the output slots. As shown in FIG. 18, left and right channel audio signals 1811, 1812 are fed into a sound processor 1810, as described before with respect to, e.g., FIG. 3, and modified left and right channel audio signals 1848, 1849 are generated. The left channel audio signal 1848 is applied to the "rear" left speaker 1814*a* (via driver 1891) and, though a delay 1881, to the "front" left speaker 1814*b* (via driver 1892). Similarly, the right channel audio signal 1849 is applied to the "rear" right speaker 1815*a* (via driver 1893) and, through a delay 182, to the "front" right speaker 1815*b* (via driver 1984). If a tweeter 1817 (or other additional speaker) is provided, then the appropriate audio signal 1847 may be provided to the tweeter 1817 through a delay 1883 and driver 1895. The delays 1881, 1882, and 1883 may be derived from the distance between each front speaker 1814*b*, 1815*b* and its respective rear speaker 1814*a*, 1815*a*, given the known velocity of sound travel. For example, assuming the left and right channels are symmetrical in layout, the delays 1881, 1882 are preferably based upon the center-to-center distance of the rear speaker 1814*a*, 1815*a* to the front speaker 1814*b*, 1815*b*, divided by the velocity of sound.(about 1116 feet per second). Analogously, the delay 1883 for the tweeter 1817 is preferably based upon the center-to-center distance of the tweeter 1817 to the front speakers 1814*b*, 1815*b* along the lengthwise axis of the sound ducts. The delays 1881, 1882, 1883 may take the form of any suitable electronic circuitry (either active or passive), and preferably have no impact on the content of the audio signals 1847, 1848, 1849, at least over the frequencies being audially reproduced by the speakers.

While the example illustrated in FIG. 18 shows a particular system configuration, it will be appreciated that other variations may be made as well drawing upon similar principles. For example, rather than having five drivers 1891-1895, one for each speaker 1814*a*, 1814*b*, 1815*a*, 1815*b*, and 1817, fewer drivers (e.g., three) or more may be used, with, for example, a single driver being shared by two speakers (e.g., 1814*a* and 1814*b*).

In one aspect, an automotive sound system is provided which encompasses a combination of speaker configuration, speaker placement, and sound processing to reduce or minimize the undesired sonic effects of the inevitable asymmetries between the listeners and speaker positions in a car or similar vehicle, and to provide more uniform sound for all the occupants. A pair of speakers, or two (or more) rows of speakers, are preferably placed close together and located in the front of the console or dashboard with their geometric center on, or as near as possible to, the central axis of symmetry of the vehicle. A sound processor acts to "spread" the sound image produced by the two closely spaced speakers by employing a cross-cancellation technique in which the cancellation signal is preferably derived from the difference between the left and right channels. The resulting difference signal is scaled, delayed (if necessary), and spectrally modified before being added to the left channel and, in opposite polarity, to the right channel. The pair of speakers may be placed on a common mounting surface, and/or in a common housing enclosure having a slot for allowing sound to emanate. Additional bass speakers may be added (in the doors, for example) to enhance bass sound reproduction.

In various embodiments as described herein, improved sound quality results from creation of a sound image that has stability over a larger area than would otherwise be experienced with, e.g., speakers spaced far apart without comparable sound processing. Consequently, the audio product can be enjoyed with optimal or improved sound over a larger area, and by more listeners who are able to experience improved sound quality even when positioned elsewhere than the center of the speaker arrangement. Thus, for example, an automobile or vehicular sound system may be capable of providing quality sound to a greater number of listeners, not all of whom need to be positioned in the center of the speaker arrangement in order to enjoy the rendition of the particular audio product.

It will be appreciated that a drive unit or speaker system having sound radiated through a slot or aperture can be useful with a single channel or speaker, as well as with multiple channels or speakers, even apart from the use of signal processing to, e.g., modify or improve the sound output of two closely spaced centrally located speakers. For example, one or more speakers may be located in a central slotted speaker enclosure or arrangement with or without added signal processing to produce a widened sound image or similar effects. Similarly, one or more speakers may be located in a slotted speaker enclosure or arrangement on the left and/or right sides of the vehicle, or in other locations (along the central axis or otherwise), in order to provide speaker outputs having a minimized output profile or minimized radiating surface area. For example, using the audio sound system 800 as an example, any or all of left or right speakers 824, 825, 834 and 834 may be individually placed within an interior structure of the vehicle (such as a console, side or ceiling structure, door, etc.) such that the speaker's sound is carried via a sound duct through an output slot, similar to the arrangement illustrated in, e.g., FIG. 23A or 23B (but with only a single speaker in this example instead of two speakers). A drive unit or speaker configured in such a manner may have improved visual appearance, take up less surface area, and/or provide an improved directional characteristic (which can be particularly important if the speaker is located at other than ear level).

In any of the foregoing embodiments, the audio product from which the various audio source signals are derived, before distribution to the various automobile speakers or other system components as described herein, may comprise any audio work of any nature, such as, for example, a musical piece, a soundtrack to an audio-visual work (such as a DVD or other digitally recorded medium), or any other source or content having an audio component. The audio product may be read from a recorded medium, such as, e.g., a cassette, compact disc, CD-ROM, or DVD, or else may be received wirelessly, in any available format, from a broadcast or point-to-point transmission. The audio product preferably has at least left channel and right channel information (whether or not encoded), but may also include additional channels and may, for example, be encoded in a surround sound or other multi-channel format, such as Dolby-AC3, DTS, DVD-Audio, etc. The audio product may also comprise digital files stored, temporarily or permanently, in any format used for audio playback, such as, for example, an MP3 format or a digital multi-media format.

The various embodiments described herein can be implemented using either digital or analog techniques, or any combination thereof. The term "circuit" as used herein is meant broadly to encompass analog components, discrete digital components, microprocessor-based or digital signal processing (DSP), or any combination thereof. The invention is not to be limited by the particular manner in which the operations of the various sound processing embodiments are carried out.

While examples have been provided herein of certain preferred or exemplary filter characteristics, transfer functions, and so on, it will be understood that the particular characteristics of any of the system components may vary depending on the particular implementation, speaker type, relative speaker spacing, environmental conditions, and other such factors. Therefore, any specific characteristics provided herein are meant to be illustrative and not limiting. Moreover, certain components, such as the spectral weighting filter described herein with respect to various embodiments, may be programmable so as to allow tailoring to suit individual sound taste.

The spectral weighting filter in the various embodiments described herein may provide spectral weighting over a band smaller or larger than the 200 Hertz to 2 KHz band. If the selected frequency band for spectral weighting is too large, then saturation may occur or clipping may result, while if the selected frequency band is too small, then the spreading effect may be inadequate. Also, if cross-cancellation is not mitigated at higher frequencies, as it is in the spectral weighting filters illustrated in certain embodiments herein, then a comb filter effect might result which will cause nulls at certain frequencies. Therefore, the spectral weighting frequency band, and the particular spectral weighting shape, is preferably selected to take account of the physical limitations of the speakers and electronic components, as well as the overall quality and effect of the speaker output.

While certain system components are described as being "connected" to one another, it should be understood that such language encompasses any type of communication or transference of data, whether or not the components are actually physically connected to one another, or else whether intervening elements are present. It will be understood that various additional circuit or system components may be added without departing from teachings provided herein.

In some embodiments, the pair of closely spaced speakers may be forced to work harder than they would without cross-cancellation, because the cross-mixing of left and right signals requires that the speakers reproduce out-of-phase sound waves. To compensate for this effect, it may, for example, be desirable in some embodiments to increase the size of the amplifier(s) feeding the audio signals to the pair of closely spaced speakers. In any of the embodiments described herein, the speakers utilized in the automobile sound system may be passive or active (i.e., with built-in or on-board amplification capability) in nature. The various audio channels may be individually amplified, level-shifted, boosted, equalized, or otherwise conditioned appropriately for each individual speaker or pair of speakers.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. A vehicle sound system, comprising:

a pair of speaker drive units positioned as a left drive unit and a right drive unit in close proximity within a vehicle, said drive units each outputting forward radiation towards a flat, rigid reflecting surface of a truncated sound duct terminating in a horizontal elongate slot; and a sound processor receiving as inputs a left channel audio signal and a right channel audio signal from an audio source, said sound processor configured to mix a spectrally weighted difference signal with said left channel audio signal and said right channel audio signal, and to output a resulting modified left channel audio signal and modified right channel audio signal to said pair of drive units;

wherein said truncated sound duct is straight;

wherein said drive units are oriented such that they are opposite from and substantially parallel with said reflective surface;

wherein the drive units are mounted on a baffle thereby isolating their forward acoustic radiation from their rearward acoustic radiation relative to the listening area.

2. The vehicle sound system of claim 1, wherein the modified left channel audio signal and modified right channel audio signal cause said pair of drive units to generate a widened sound image.

3. The vehicle sound system of claim 1, wherein the length of said sound duct is shorter than a wavelength corresponding to a maximum frequency of said left channel audio signal and right channel audio signal.

4. The vehicle sound system of claim 1, wherein said sound processor mixes said spectrally weighted difference signal with said left channel audio signal and said right channel audio signal by cross-canceling said spectrally weighted difference signal with said left channel audio signal and said right channel audio signal, respectively.

5. The vehicle sound system of claim 1, wherein said left drive unit and said right drive unit are positioned substantially on or near a center axis of the vehicle.

6. The vehicle sound system of claim 1, wherein said left drive unit and said right drive unit are located immediately adjacent to one another.

7. The vehicle sound system of claim 1, wherein said pair of drive units are mounted on a speaker mounting structure, and wherein said drive units are enclosed so as to isolate forward and rear radiation thereof.

8. The vehicle sound system of claim 7, wherein said speaker mounting structure is adapted for placement within the vehicle such that said pair of drive units are contained within an interior structure of the vehicle, and wherein said horizontal elongate slot is located on a front console of the vehicle.

9. The vehicle sound system of claim 1, wherein said sound duct has height and width dimensions approximately conforming to the height and width dimensions of said horizontal elongate slot.

10. The vehicle sound system of claim 1, wherein said sound duct has no sharp turns or bends.

11. The vehicle sound system of claim 1, wherein said pair of drive units are acoustically packaged such that they output all of their forward radiation into said sound duct and towards said horizontal elongate slot.

12. The vehicle sound system of claim 1, wherein said pair of drive units are both oriented either in a downwards or upwards direction.

13. The vehicle sound system of claim 1, further comprising a sound-damping material residing within said sound duct and opposite said horizontal elongate slot, wherein each of said drive units comprises a speaker cone having a rear edge opposite said horizontal elongate slot, and wherein said sound-damping material generally conforms to outer contours of said rear edges of the speaker cones in a manner such that each drive unit's forward acoustic radiation is directed towards said horizontal elongate slot.

14. The vehicle sound system of claim 1, wherein said sound duct is partitioned into a separate duct for each of said pair of drive units.

15. The vehicle sound system of claim 14, further comprising a first additional left drive unit in series along the same sound duct as the left drive unit and further removed from said horizontal elongate slot, and a second additional right drive unit in series along the same sound duct as the right drive unit and further removed from said horizontal elongate slot.

16. The vehicle sound system of claim 1, further comprising a pair of door-mounted left and right drive units receiving versions of said left channel audio signal and said right channel audio signal, respectively.

17. The vehicle sound system of claim 16, wherein the door-mounted left drive unit receives at least a portion of a difference between the left channel audio signal and the right channel audio signal, and wherein the door-mounted right drive unit receives at least a portion of a difference between the right channel audio signal and the left channel audio signal.

18. The vehicle sound system of claim 1, wherein said sound processor is configured to generate a difference signal representing a difference between said left channel audio signal and said right channel audio signal, apply a spectral weighting to said difference signal to restore proper timbral balance thereby generating a spectrally weighted signal, and cross-cancel said spectrally weighted signal with said left channel audio signal and said right channel audio signal, thereby generating said modified left channel audio signal and modified right channel audio signal for said pair of drive units.

19. A vehicle sound system, comprising:

a pair of speaker drive units in close proximity within a vehicle; and a sound processor receiving as inputs a left channel audio signal and a right channel audio signal from an audio source, said sound processor configured to mix a spectrally weighted difference signal with said left channel audio signal and said right channel audio signal, and to output a resulting modified left channel audio signal and modified right channel audio signal to said pair of drive units;

wherein said pair of drive units are mounted on a common speaker mounting structure;

wherein said speaker mounting structure is adapted for placement within the vehicle such that said pair of drive units are enclosed within an interior structure of the vehicle, and wherein at least one sound duct carries sound from said pair of speakers to an orifice located on the interior structure of the vehicle;

wherein said at least one sound duct comprises two sound ducts, one sound duct for each of said pair of drive units;

wherein said pair of speakers are positioned as a left drive unit and a right drive unit, the sound system further comprising a first additional left drive unit in series along the same sound duct as the left drive unit and further removed from said orifice, and a second additional right drive unit in series along the same sound duct as the right drive unit and further removed from said orifice; and wherein the modified left channel audio signal is applied to said left drive unit with a first delay relative to said additional left drive unit such that destructive interference between said left drive unit and said additional left drive unit is reduced, and wherein the modified right channel audio signal is applied to said right drive unit with a second delay relative to said additional right drive unit such that destructive interference between said right drive unit and said additional right drive unit is reduced.

20. The vehicle sound system of claim 19, wherein said left drive unit and right drive unit are symmetrically positioned with respect to said elongate slot, wherein said additional left drive unit and said additional right drive unit are symmetrically positioned with respect to said elongate slot, and wherein first delay and said second delay are equal.

21. A vehicle sound system, comprising:

a pair of speaker drive units in close proximity within a vehicle;

a sound processor receiving as inputs a left channel audio signal and a right channel audio signal from an audio source, said sound processor configured to mix a spectrally weighted difference signal with said left channel audio signal and said right channel audio signal, and to output a resulting modified left channel audio signal and modified right channel audio signal to said pair of drive units; and at least one additional drive unit located in proximity to said pair of drive units;

wherein said pair of drive units are mounted on a common speaker mounting structure;

wherein said speaker mounting structure is adapted for placement within the vehicle such that said pair of drive units are enclosed within an interior structure of the vehicle, and wherein at least one sound duct carries sound from said pair of speakers to an orifice located on the interior structure of the vehicle;

wherein said at least one sound duct comprises two sound ducts, one sound duct for each of said pair of drive units; and wherein said pair of speakers are positioned as a left drive unit and a right drive unit, the sound system further comprising a first additional left drive unit in series along the same sound duct as the left drive unit and further removed from said orifice, and a second additional right drive unit in series along the same sound duct as the right drive unit and further removed from said orifice.

22. The vehicle sound system of claim 21, wherein said at least one additional drive unit outputs sound through a portion of said elongate slot.

23. The vehicle sound system of claim 21, wherein said at least one additional drive unit is oriented directly towards the interior of the vehicle.

24. A method of sound reproduction for the interior of a vehicle, the method comprising the steps of:

positioning a left drive unit and a right drive unit in close proximity within a vehicle;

receiving a left channel audio signal and a right channel audio signal from an audio source, said left channel audio signal and right channel audio signal being stereo in nature;

processing said left channel audio signal and said right channel audio signal and generating a modified left channel audio signal and modified right channel audio signal thereby, such that applying said modified left channel audio signal and modified right channel audio signal to said left drive unit and right drive unit, respectively, results in a widened sound image; and directing the forward acoustic radiation of said drive units through a truncated sound duct such that the sound energy is emitted from a horizontal orifice while isolating the rear acoustic radiation of said drive units from the forward radiation of said drive units relative to the listening area;

wherein said truncated sound duct is straight and comprises a flat, rigid reflective surface opposite said drive units, said drive units being oriented such that they are substantially parallel with said reflective surface.

25. The method of claim 24, wherein the step of processing said left channel audio signal and said right channel audio signal comprises the step of mixing a spectrally weighted difference signal with said left channel audio signal and said right channel audio signal.

26. The method of claim 25, wherein said step of mixing a spectrally weighted difference signal with said left channel audio signal and said right channel audio signal comprises the steps of obtaining a difference signal representing a difference between said left channel audio signal and said right channel audio signal, spectrally weighting said difference signal to restore proper timbral balance, and cross-canceling the spectrally weighted difference signal from the left channel audio signal and the right channel audio signal.

27. The method of claim 24, wherein said left drive unit and said right drive unit are positioned substantially on or near a center axis of the vehicle.

28. The method of claim 27, wherein said left drive unit and said right drive unit are oriented in parallel and located substantially adjacent to one another.

29. The method of claim 27, further comprising the step of mounting said pair of drive units on a common baffle.

30. The method of claim 24, further comprising the steps of enclosing said drive units in a speaker mounting structure such that the forward acoustic radiation from said drive units is mechanically isolated from their rear acoustic radiation;

placing said speaker mounting structure within a front console of the vehicle such that said pair of drive units are enclosed within an interior structure of the vehicle.

31. The method of claim 30, further comprising the step of placing at least one additional drive unit in proximity to said left drive unit and said right drive unit.

32. The method of claim 31, wherein said at least one additional drive unit outputs sound through at least a portion of said horizontal orifice.

33. The method of claim 24, wherein said orifice comprises a horizontal slot, and wherein said truncated sound duct has no sharp or perpendicular turns, and has height and width dimensions approximately conforming to the height and width dimensions of said horizontal slot.

34. The method of claim 24, further comprising the step of providing sound-damping material within said sound duct and opposite said horizontal orifice, said sound-damping material forcing the forward acoustic radiation from said drive units to be directed through said sound duct towards said horizontal orifice.

35. The method of claim 24, further comprising the steps of placing a first additional left drive unit in series with the left drive unit and further removed from said horizontal orifice, and placing a second additional right drive unit in series with the right drive unit and further removed from said horizontal orifice.

36. The method of claim 24, further comprising the step of mounting left and right bass drive units in left and right doors of the vehicle, said left and right bass drive units receiving low-pass filtered versions of said left channel audio signal and said right channel audio signal, respectively.

37. A method of sound reproduction for the interior of a vehicle, the method comprising the steps of:

positioning a left drive unit and a right drive unit in close proximity within a vehicle;

receiving a left channel audio signal and a right channel audio signal from an audio source, said left channel audio signal and right channel audio signal being stereo in nature;

processing said left channel audio signal and said right channel audio signal and generating a modified left channel audio signal and modified right channel audio signal thereby, such that applying said modified left channel audio signal and modified right channel audio signal to said left drive unit and right drive unit, respectively, results in a widened sound image;

placing a first additional left speaker in series with the left drive unit and further removed from said orifice, and placing a second additional right drive unit in series with the right drive unit and further removed from said orifice; and applying the modified left channel audio signal to said left drive unit with a first delay relative to said additional left drive unit such that destructive interference between said left drive unit and said additional left drive unit is reduced, and applying the modified right channel audio signal to said right drive unit with a second delay relative to said additional right drive unit such that destructive interference between said right drive unit and said additional right drive unit is reduced.

38. The method of claim 37, wherein said left drive unit and right drive unit are symmetrically positioned with respect to said horizontal orifice, wherein said additional left drive unit and said additional right drive unit are symmetrically positioned with respect to said horizontal orifice, and wherein first delay and said second delay are equal.

* * * * *